US011037047B2

(12) United States Patent
Christie et al.

(10) Patent No.: US 11,037,047 B2
(45) Date of Patent: Jun. 15, 2021

(54) COUNTING DEVICES

(71) Applicant: Coalesce Product Development Ltd, Cambridge (GB)

(72) Inventors: Ewen Humphrey Christie, Moray (GB); Robin Craig Cocker, Nottingham (GB)

(73) Assignee: Coalesce Product Development Ltd., Cambridge (GB)

( * ) Notice: Subject to any disclaimer, the term of this patent is extended or adjusted under 35 U.S.C. 154(b) by 833 days.

(21) Appl. No.: 15/534,356

(22) PCT Filed: Dec. 10, 2015

(86) PCT No.: PCT/GB2015/000323
§ 371 (c)(1),
(2) Date: Jun. 8, 2017

(87) PCT Pub. No.: WO2016/092252
PCT Pub. Date: Jun. 16, 2016

(65) Prior Publication Data

US 2017/0364789 A1 Dec. 21, 2017

(30) Foreign Application Priority Data

Dec. 10, 2014 (GB) ..... 1421983

(51) Int. Cl.
*G06M 1/16* (2006.01)
*G06M 1/14* (2006.01)
(Continued)

(52) U.S. Cl.
CPC ..... *G06M 1/166* (2013.01); *G06M 1/146* (2013.01); *G06M 1/16* (2013.01); *G06M 1/245* (2013.01);
(Continued)

(58) Field of Classification Search
CPC ..... G06M 1/166; G06M 1/16; G06M 1/26; G06M 1/245; G06M 1/146; G06M 1/248; G06M 1/14
See application file for complete search history.

(56) References Cited

U.S. PATENT DOCUMENTS 1,962,923 A * 6/1934 Borel ..... G07F 15/06 194/296
2,151,086 A * 3/1939 Dietrich ..... H04M 15/30 235/91 E
(Continued)

FOREIGN PATENT DOCUMENTS

CH 350821 A 12/1960
EP 1386630 A1 2/2004
(Continued)

OTHER PUBLICATIONS

International Search Report issued for PCT/GB2015/000323, dated Apr. 5, 2016.
(Continued)

*Primary Examiner* — Nimeshkumar D Patel
*Assistant Examiner* — Tania Courson
(74) *Attorney, Agent, or Firm* — Westman, Champlin & Koehler, P.A.; Z. Peter Sawicki; Amanda M. Prose

(57) ABSTRACT

A counting device for counting mechanical inputs comprising: a rotatably mounted first counting wheel arranged to rotate by a predetermined amount for every input that is to be counted; and, a second counting wheel in mechanical communication with the first counting wheel, and at least in part overlapping the first counting wheel, wherein the second counting wheel and/or the first counting wheel are at least in part transparent; whereby the mechanical communication between the first counting wheel and the second counting wheel comprises a rotation mechanism configured to drive the second counting wheel a predetermined amount
(Continued)

when a predetermined number of inputs has been reached. A counting device for counting mechanical inputs comprising: a rotatably mounted first counting wheel arranged to rotate by a predetermined amount for every input that is to be counted; and, a second counting wheel in mechanical communication with the first counting wheel, whereby the mechanical communication between the first counting wheel and the second counting wheel comprises a locking mechanism comprising a formation on the second counting wheel configured to engage with a housing peg, a first counting wheel formation or a lock, and a rotation mechanism configured to drive the second counting wheel a predetermined amount when a predetermined number of inputs has been reached.

16 Claims, 39 Drawing Sheets

(51) Int. Cl.
*G06M 1/26* (2006.01)
*G06M 1/24* (2006.01)

(52) U.S. Cl.
CPC ..... *G06M 1/26* (2013.01); *G06M 1/14* (2013.01); *G06M 1/248* (2013.01)

(56) References Cited

U.S. PATENT DOCUMENTS 3,605,517 A * 9/1971 Borel ..... F16H 27/06 74/436
3,760,519 A * 9/1973 Niven ..... G06M 1/02 235/114
3,874,587 A * 4/1975 McGann ..... G06M 1/163 235/131 R
4,317,385 A * 3/1982 Harvey ..... F16H 27/06 74/436
4,531,051 A * 7/1985 Sagmuller ..... G06M 1/166 235/1 C
5,799,651 A * 9/1998 Garby ..... A61J 7/04 128/200.23
5,988,496 A * 11/1999 Bruna ..... G06M 1/041 222/18
6,283,365 B1 * 9/2001 Bason ..... G06M 1/041 235/116
6,328,037 B1 * 12/2001 Scarrott ..... A61M 15/0065 128/200.23
6,374,055 B1 * 4/2002 Schroder ..... G03B 1/66 396/284
7,137,391 B2 11/2006 Bruna
7,191,918 B2 * 3/2007 Ouyang ..... A61M 15/009 128/205.23
8,113,199 B2 * 2/2012 Augustyn ..... A61M 15/0045 128/205.23
8,245,906 B2 * 8/2012 Crosby ..... A61M 15/0075 235/50 R
8,479,732 B2 * 7/2013 Stuart ..... A61M 15/009 116/315
8,656,911 B2 * 2/2014 Elliman ..... G06M 1/045 128/203.12
9,089,661 B2 * 7/2015 Stuart ..... A61M 15/009
9,125,999 B2 * 9/2015 Rolfs ..... A61M 15/0051
9,399,103 B2 * 7/2016 Houzego ..... A61M 15/0073
2015/0231346 A1 * 8/2015 Bilgic ..... A61M 15/0053 128/203.15

FOREIGN PATENT DOCUMENTS

FR 323270 A 3/1903
WO 2007034237 A1 3/2007
WO 2007077450 A2 7/2007
WO 2007124406 A2 11/2007

OTHER PUBLICATIONS

Written Opinion of the International Searching Authority issued for PCT/GB2015/000323, dated Apr. 5, 2016.

* cited by examiner

COUNTING DEVICES

This invention relates to counting devices, and in particular mechanical counting devices for medicament dispensers.

Many medicament dispensers require a means to display the number of doses of medicament that remain within the device or the number of doses that have been dispensed. This count allows a user, or a medical professional, to track usage of the device within the unit itself, to ensure that the device is being used as prescribed, and to alert as to how many doses remain to ensure that the user always has a medicament available. These medicament dispensers include inhalers, such as dry powder inhalers, metered dose inhalers, and similar devices.

A number of these medicament dispensers incorporate a mechanical or electronic counting device to keep count of a number of doses that remain or that have been dispensed. Typically, these medicament dispensers are required to be available to a user at all times, and therefore they are often transported in a pocket, handbag or otherwise. The dispenser, and therefore the counting device contained therein, needs to be relatively robust to cope in these environments when subjected to adverse conditions, which might include various impacts and vibrations, and the attempted ingress of dirt and other detritus. However, there is also a trade-off that whilst being robust they need to be relatively compact and space-efficient, making them easy to transport so that a user is encouraged to carry them on their person or in with their essential items at all times. Likewise, the counting device should not take up excessive space within the dispenser itself.

It is vital that where a counting device is included within the dispenser, the count displayed on the device at any one time is accurate. An inaccurate count displayed on the device can lead to confusion as to whether a prescribed dosage has been followed, wastage of medicament when a device is disposed of before a medicament has run out, or a potentially dangerous situation where the medicament has run out although the count reads that there should be some available, and a user is therefore without the dose that they need. Whilst electronic counting devices typically overcome this problem of unwanted movement of mechanical parts leading to an inaccurate count, they add considerable cost to what is often a disposable item. However, mechanical counting devices, whilst typically providing a more cost-effective option that is also not reliant on a power source, can often be affected by any unwanted movement.

The number of component parts within a dose counter can also have an effect on the likelihood of failure, or of the count being inaccurate. Typically, lots of component parts can also mean a more expensive device to manufacture and assemble. The market for medicament dispensers is greatly affected by cost, with manufacturers seeking ways to reduce unit cost wherever possible.

Another problem with existing devices is the size of the count that is displayed to the user of the counting device. The count is often viewed by a user through a small window in a housing of the counting device, and the size of the number that is displayed can be hard to read, particularly for those mechanical counting devices that incorporate a single wheeled device that displays a count value. To allow the wheel to be of a suitable size to fit within the body of a typical inhaler, it must be of a suitable diameter. This can leave little room in which to fit numbers that count up to or down from sixty, one hundred, or a value even more than that for some medicament dispensers. Those counting devices that comprise a units wheel and a tens wheel attempt to deal with this issue. However, typically these require side-by-side wheels, or a concentric arrangement of wheels, and again to fit this within the body of a typical medicament dispenser, the wheels must be as small as possible, leaving little space in which to fit the numbers.

The prior art shows a number of devices which attempt to address these needs in various ways.

U.S. Pat. No. 6,405,727 (PA Knowledge Limited) discloses a dosing device with dose counter. The count indication is given by two wheels, whereby each wheel comprises a toothed disc portion and a smooth disc. The smooth disc of each wheel bears the digits, that when viewed together through a display window, can show a count for the number of doses remaining or used. A flexible lever acts on ratchet teeth moulded on the wheel, this lever comprising a pin feature which engages with a yoke. Whilst this device comprises a dual wheel arrangement, allowing for a count up to a value of 209, the wheels are mounted adjacent to each other, and therefore they need to be small to be of a suitable size to fit within a portable inhaler device. The use of small wheels, with small smooth discs, leads to very small digits on each display, and therefore a hard to read count. If larger wheels are used, the counting device takes up valuable space within the inhaler device, making the unit somewhat cumbersome and bulky, and not as portable and convenient as it should be. This dose counter does not provide any definite means of ensuring count accuracy, and it is therefore conceivable that it could be affected by impacts and vibrations, changing the count without a dose having been taken.

WO 2005/079727 (Glaxo Group Limited) discloses a counter for use with a medicament dispenser, where the counter comprises a first count wheel and a second count wheel, both provided with drive teeth, and a kick wheel that drives the second count wheel. The first count wheel incorporates a fixed index tooth arranged for intermittent meshing with the kick teeth of the kick wheel such that rotary motion of the kick wheel results from rotary motion of the first count wheel only when the intermittent meshing occurs. The second count wheel in one embodiment is contained within the first count wheel that comprises a ring. This arrangement allows the numbers displayed on each wheel to be easier to read when the count wheels are of a size suitable for a medicament dispenser. However, this counter requires a pair of count wheels, both with drive teeth, and a kick wheel and input wheel that have corresponding teeth. It is conceivable that such an arrangement could display an inaccurate count if subjected to impacts and vibrations.

Whilst the prior art appears to address the problems associated with number size and hard to read counts by providing a dual wheeled arrangement, and keeping footprint size to a minimum by mounting one wheel inside another, they do not appear to address these issues alongside the additional issues of count accuracy, number of component parts, and complexity of manufacturing and assembling these component parts.

Preferred embodiments of the present invention aim to provide a counting device with a count display that is easy to read, where the numbers are clear, that is space-efficient, that keeps part count to a minimum and therefore is cost-effective to manufacture, whilst also providing means to ensure that the count that is displayed is accurate.

According to one aspect of the present invention, there is provided a counting device for counting mechanical inputs comprising:

- a rotatably mounted first counting wheel arranged to rotate by a predetermined amount for every input that is to be counted; and, a second counting wheel in mechanical communication with the first counting wheel, and at least in part overlapping the first counting wheel, wherein the second counting wheel and/or the first counting wheel are at least in part transparent;

whereby the mechanical communication between the first counting wheel and the second counting wheel comprises a rotation mechanism configured to drive the second counting wheel a predetermined amount when a predetermined number of inputs has been reached.

In an alternative embodiment, counting device for counting mechanical inputs comprising:

a rotatably mounted first counting wheel arranged to rotate by a predetermined amount for every input that is to be counted; and, a second counting wheel in mechanical communication with the first counting wheel, whereby the mechanical communication between the first counting wheel and the second counting wheel comprises a locking mechanism comprising a formation on the second counting wheel configured to engage with a housing peg, a first counting wheel formation or a lock, and a rotation mechanism configured to drive the second counting wheel a predetermined amount when a predetermined number of inputs has been reached.

In some embodiments, the mechanical communication between the first counting wheel and the second counting wheel may be direct. Advantages of such an arrangement include that the counting device is simplified because additional features such as slave wheels are avoided. This can reduce the part count, size, and tolerance chain length of the counting device and can improve accuracy, alignment of indicia, and reliability.

In some embodiments, the counting device may comprise a rotational locking mechanism which is configured to prevent rotation of the second counting wheel. The rotational locking mechanism is also referred to herein as a rotating locking mechanism. It should be understood that this locking mechanism prevents rotational movement.

In some embodiments, the first counting wheel may engage with the second counting wheel to activate the rotating locking mechanism; for example, the first counting wheel may comprise a cam track or a rail which activates the rotating locking mechanism. Thus the rotational locking mechanism provides the counting device with a rigid physical feature that prevents rotational movement of the second counting wheel when engaged, which substantially avoids the risk of a miscount due to the device being dropped or shaken. Compared to a ratchet or detent feature, this rotational locking mechanism can reduce the force required to index when the rotational locking mechanism is disengaged, and allows the counting device to count bi-directionally, which may be advantageous, for example during assembly, or in certain use-cases.

In some embodiments, the rotational locking mechanism may comprise a second counting wheel formation configured to engage with the first counting wheel, the housing or a lock.

In some embodiments, the rotational locking mechanism may be activated by the first counting wheel moving the second counting wheel from a configuration where it can rotate to a configuration where it cannot rotate.

In some embodiments, the rotational locking mechanism may comprise a first counting wheel formation to engage the second counting wheel formation such that it cannot rotate; for example, the first counting wheel formation may be a first counting wheel peg on the surface of the first counting wheel; for example, the first counting wheel peg may be at the hub of the first counting wheel.

In some embodiments, the rotating locking mechanism may comprise a second counting wheel formation which is a projecting peg which is configured to engage with a first counting wheel rail.

In some embodiments, the rotational locking mechanism may comprise a lock to engage with the second counting wheel such that it cannot rotate wherein the lock is activated by the first counting wheel; for example, the lock may be a sliding lock comprising a lock peg which engages with a first counting wheel formation to activate the lock. In some embodiments, the first counting wheel formation may be a rail. In some embodiments, the sliding lock may be mounted on a housing guide.

In some embodiments, the first counting wheel and the second counting wheel may not be coaxial when the locking mechanism is activated.

In some embodiments, one or both counting wheels may have a thin edge (for example having a thickness of from 10 to 400 μm, for example from 40 to 200 μm or less). In some embodiments, one or both counting wheels may comprise a thin annular ring. In some embodiments, the annular ring may be supported by a circumferential lip on the counting ring. In some embodiments, the circumferential lip has a height sufficient for a counting wheel volume to be formed which is suitable for receiving the other counting wheel such that the counting device may be a compact counting device having interleaved counting wheels. In some embodiments, counting indicia are marked on the thin annular ring. This arrangement can provide a display that is almost as clear as using transparent effects, but without requiring transparent materials. Additionally, there is a limit to how thin a typical part of a given size and material can be made using certain manufacturing processes, yet films in the same materials can be manufactured with significantly thinner wall thicknesses. By combining parts made using different manufacturing processes, for example, injection mouldings with wall thicknesses that might be limited to a minimum of e.g. 0.5 mm with pieces cut from film of thickness 0.1 mm, very thin parts with locally thicker regions suitable for mechanical interactions can be achieved. The overall thickness of the resulting counting device need not be much thicker than one or two of the locally thicker regions, even with overlapping wheels. Without the use of thinner areas, the same counting device will be at least three thicker wall thicknesses thick. Furthermore, if the thin part is at least in part opaque, it can obscure mechanical features in the locally thicker regions that would otherwise visually disrupt a display surface, allowing mechanisms and display surfaces to overlap without compromising the clarity of the display. Finally, the range and type of features achievable in a wheel or any other part is typically greater if the part is an assembly of other parts. In particular, forming undercuts in injection mouldings can be very difficult or impossible, but these undercuts are required in some of the embodiments herein in order to further reduce the size of the counting device.

In some embodiments, the counting device may comprise a housing.

In some embodiments, the housing comprises a location mechanism configured to substantially prevent non-rotational movement of the second counting wheel, relative to the housing.

In some embodiments, the location mechanism comprises a housing formation configured to engage the second counting wheel.

In some embodiments, the housing formation comprises a housing slot or housing hole and the second counting wheel comprises at least one second counting wheel peg configured to engage with the housing slot or housing hole, or the housing formation comprises a housing peg and the second counting wheel comprises a hub which is configured to receive the housing peg.

In some embodiments, the first counting wheel formation comprises a first counting wheel peg on the surface of the first counting wheel; preferably the first counting wheel peg is at the hub of the first counting wheel.

In some embodiments, the formation on the second counting wheel is a projecting peg and wherein the first counting wheel formation is a rail.

In some embodiments, the lock is a movable lock comprising a lock peg which engages with a first counting wheel formation; preferably the first counting wheel formation is a rail.

In some embodiments, the movable lock is mounted on a housing guide.

In some embodiments, the mechanical communication comprises a release mechanism for releasing the locking mechanism.

In some embodiments, the release mechanism changes the configuration of the first counting wheel and second counting wheel from a first configuration to a second configuration.

In some embodiments, the release mechanism comprises a first counting wheel cam and a second counting wheel formation.

In some embodiments, the release mechanism comprises a first counting wheel rail gap and at least one second counting wheel formation or a sliding lock peg.

In some embodiments, the rotation mechanism comprises a first counting wheel formation configured to engage with at least one second counting wheel formation.

In some embodiments, the first counting wheel and the second counting wheel each comprise a circumferential array of counting indicia.

In some embodiments, the first counting wheel incorporates a circumferential array of unit count indicia and the second counting wheel incorporates a circumferential array of tens count indicia, and the first counting wheel is at least in part overlapping the second counting wheel, whereby for every input a unit count indicia is aligned with a tens count indicia that represents the number of inputs.

In some embodiments, the transparent portion of the second counting wheel is where the second counting wheel is in an overlapping relationship with the first counting wheel.

In some embodiments, the units indicia and the tens indicia are configured such that a particular combination of units indicia and tens indicia is displayed, wherein the first counting wheel or the second counting wheel incorporates at least one window.

In some embodiments, the housing incorporates at least one window for viewing any count indicia on the first counting wheel and the second counting wheel.

In some embodiments, the first counting wheel comprises an opaque portion and/or the second counting wheel comprises an opaque portion, whereby, in use, the first counting wheel opaque portion and/or second counting wheel opaque portion is visible through the window.

In a further embodiment, the counting device comprises a housing with at least one housing peg projecting from its surface and a housing slot;

the first counting wheel incorporates a first counting wheel peg and a first counting wheel cam track on its surface; and, the second counting wheel incorporates a second counting wheel gear, said second counting wheel gear comprising a second counting wheel gear peg and a plurality of second counting wheel gear indentations, whereby the second counting wheel gear peg extends therethrough and is configured to slot into the housing slot on one side and into the first counting wheel cam track on the other side, the second counting wheel gear peg forming a second counting wheel axle about which the second counting wheel rotates;

whereby the locking mechanism comprises a location mechanism and a rotational locking mechanism wherein the location mechanism comprises the second counting wheel gear peg engaging the housing slot and the rotational locking mechanism comprises the second counting wheel gear indentation engaging the housing peg, and the rotation mechanism comprises a second counting wheel gear indentation engaging the first counting wheel peg, and the release mechanism comprises the first counting wheel cam acting on the second counting wheel gear peg.

In some embodiments the second counting wheel is movable between a first configuration at the inner end of the housing slot where the location mechanism and rotational locking mechanism are engaged, and a second configuration at the other end of the housing slot where the rotational locking mechanism is released.

In some embodiments, a release mechanism is configured to move the second counting wheel from the first configuration to the second configuration.

In some embodiments, the first counting wheel comprises a transparent disc that at least in part overlaps the second counting wheel such that the indicia of the second counting wheel is visible therethrough.

In a further embodiment, the counting device comprises a housing with at least one housing peg projecting from its surface and a housing slot within its surface;

the first counting wheel incorporates a first counting wheel peg and a substantially circular first counting wheel cam track on its surface; and, the second counting wheel incorporates a second counting wheel gear peg and an outer second counting wheel gear, said second counting wheel gear comprising a plurality of second counting wheel gear indentations whereby the second counting wheel gear peg extends therethrough and is configured to slot into the housing slot on one side and into the first counting wheel cam track on the other side, the second counting wheel gear peg forming an axle about which the second counting wheel is rotatable;

whereby the locking mechanism comprises a location mechanism and a rotational locking mechanism wherein the location mechanism comprises the second counting wheel gear peg engaging the housing slot and the rotational locking mechanism comprises the second counting wheel gear indentation engaging the housing peg, and the rotation mechanism comprises the second counting wheel gear indentation engaging the first counting wheel peg, and the release mechanism comprises the first counting wheel cam acting on the second counting wheel gear peg.

In some embodiments, the second counting wheel is movable between a first configuration at the inner end of the housing slot where the location locking mechanism and rotational locking mechanism are engaged, and a second configuration at the other end of the housing slot where the rotational locking mechanism is released.

In some embodiments, the release mechanism is configured to move the second counting wheel from the first configuration to the second configuration.

In some embodiments, the first counting wheel comprises a transparent disk that at least in part overlaps the second counting wheel such that at least a portion of the second counting wheel is visible therethrough.

In a further embodiment, the counting device comprises a housing with a housing slot;

the first counting wheel incorporates a first counting wheel hub and a substantially circular first counting wheel cam track on its surface; and, the second counting wheel incorporates a second counting wheel gear, said second counting wheel gear comprising a second counting wheel gear peg and a plurality of second counting wheel gear indentations whereby the second counting wheel gear peg extends therethrough and is configured to slot into the housing slot on one side and into the first counting wheel cam track on the other side, the second counting wheel gear peg forming an axle about which the second counting wheel is rotatable;

whereby the locking mechanism comprises a location mechanism and a rotational locking mechanism wherein the location mechanism comprises the second counting wheel gear peg engaging the housing slot and the rotational locking mechanism comprises the second counting wheel gear indentation engaging the first counting wheel hub, the rotation mechanism is formed by the second counting wheel gear indentation engaging the first counting wheel peg, and the release mechanism comprises first counting wheel cam acting on the second counting wheel gear peg.

In some embodiments, the second counting wheel is movable between a first configuration at the inner end of the housing slot where the location locking mechanism and rotational locking mechanism are engaged, and a second configuration at the other end of the housing slot where the rotational locking mechanism is released.

In some embodiments, the release mechanism is configured to move the second counting wheel from the first configuration to the second configuration.

In some embodiments, the second counting wheel comprises a transparent disc that at least in part overlaps the first counting wheel such that the indicia of the first counting wheel is visible therethrough.

In a further embodiment, the counting device comprises a housing with at least one housing peg and at least one housing guide;

the first counting wheel incorporates a projecting first counting wheel peg and a first counting wheel inner rail which forms a first counting wheel inner rail gap;

the second counting wheel incorporates a second counting wheel gear, said second counting wheel gear comprising a second counting wheel gear hub adapted to receive the housing peg and a plurality of second counting wheel gear indentations; and, the counting device comprises a movable lock having a lock peg wherein the lock is movable from a locked position where the lock peg engages the first counting wheel inner rail to an unlocked position where the lock peg is in first counting wheel inner rail gap;

whereby the locking mechanism comprises a location mechanism and a rotational locking mechanism wherein the location mechanism comprises the housing peg and the second counting wheel gear hub and the rotational locking mechanism comprises the second counting wheel gear engaging the lock wherein the lock is in a locked position, the rotation mechanism is formed by the second counting wheel gear indentations engaging the first counting wheel peg and the release mechanism comprises the lock being moved from its locked position to its unlocked position.

In yet a further embodiment, the counting device comprises a housing with at least one housing peg;

the first counting wheel incorporates a first counting wheel inner rail having at least one first counting wheel inner rail gap and a first counting wheel peg; and, the second counting wheel incorporates a second counting wheel gear, said second counting wheel gear comprising a second counting wheel gear hub which is adapted to receive the housing peg and a plurality of second counting wheel gear teeth and second counting wheel gear indentations wherein each second counting wheel gear tooth bears a second counting wheel gear tooth peg;

whereby the locking mechanism comprises a location mechanism and a rotational locking mechanism wherein the location mechanism comprises the housing peg and the second counting wheel gear hub and the rotational locking mechanism is formed by the second counting wheel gear teeth pegs bearing against the first counting wheel inner rail and/or the first counting wheel outer rail, the rotation mechanism is formed by the second counting wheel gear teeth pegs engaging the first counting wheel peg and the release mechanism comprises the second counting wheel gear teeth and configured to align with the first counting wheel inner rail gaps.

In an additional embodiment, the counting device according to the invention has the following features:

a housing with at least one housing peg and a moving bearing plate having a moving bearing plate hole and a moving bearing plate peg;

the first counting wheel incorporates a first counting wheel peg and a first counting wheel cam track for receiving the moving bearing plate peg and having at least one first counting wheel cam; and, the second counting wheel incorporates a second counting wheel peg, a second counting wheel rotation track for receiving the first counting wheel peg and having at least one second counting wheel rotation indentation, a second counting wheel rotation lock track for receiving the housing peg and at least one second counting wheel rotation lock indentations;

whereby the locking mechanism comprises a location mechanism and a rotational locking mechanism wherein the location mechanism comprises the second counting wheel peg and the moving bearing plate hole and the rotational locking mechanism is formed by the housing peg, the second counting wheel rotation lock track and the at least one second counting wheel rotation lock indentations, the rotation mechanism is formed by the first counting wheel peg, the second counting wheel rotation track and second counting wheel rotation indentations and the release mechanism comprises the moving bearing plate peg, the first counting wheel cam track and first counting wheel cam.

In an additional embodiment, the counting device according to the invention has the following features:

the first counting wheel incorporates a first counting wheel rail having at least one first counting wheel rail gap and a first counting wheel peg; and, the second counting wheel incorporates a plurality of second counting wheel pegs;

whereby the locking mechanism comprises a rotational locking mechanism wherein the rotational locking mechanism is formed by the second counting wheel pegs bearing against the first counting wheel rail, the rotation mechanism is formed by the second counting wheel pegs engaging the first counting wheel peg and the release mechanism comprises the second counting wheel pegs and configured to align with the first counting wheel rail gaps.

In some embodiments, the second counting wheel may be configured to lock after a pre-determined number of rotations such that the release mechanism cannot release the second counting wheel.

According to the invention, there is further provided a medicament dispenser incorporating the counting device as hereinbefore described.

According to the invention, there is also provided a carrying case for a medicament dispenser incorporating the counting device as hereinbefore described.

For a better understanding of the invention and to show how embodiments of the same may be carried into effect, reference will now be made, by way of example, to the accompanying diagrammatic drawings, in which.

In the figures like references denote like or corresponding parts.

Figure 1A:
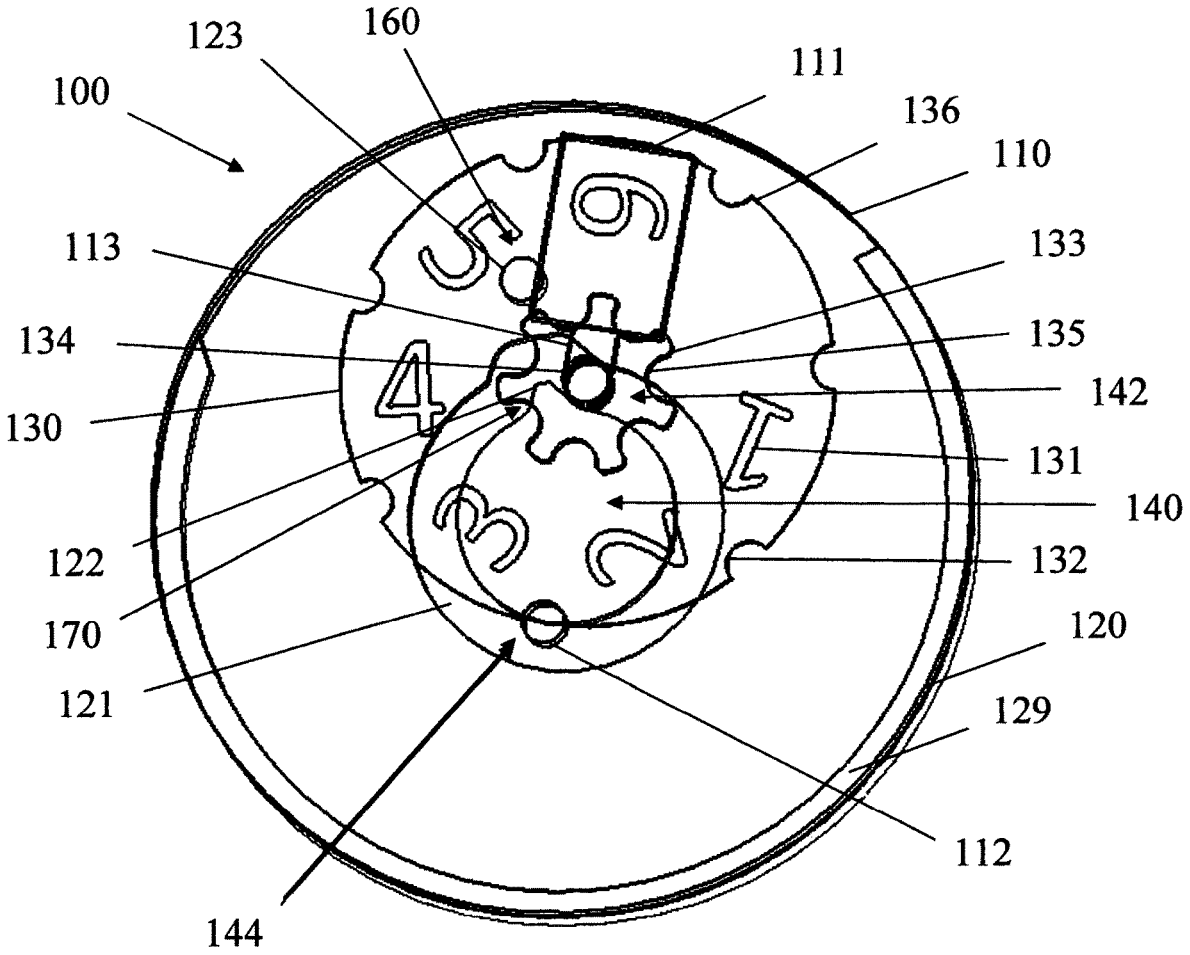
FIG. 1A shows a schematic plan view of a first embodiment of a counting device according to the invention.
Figure 1B:
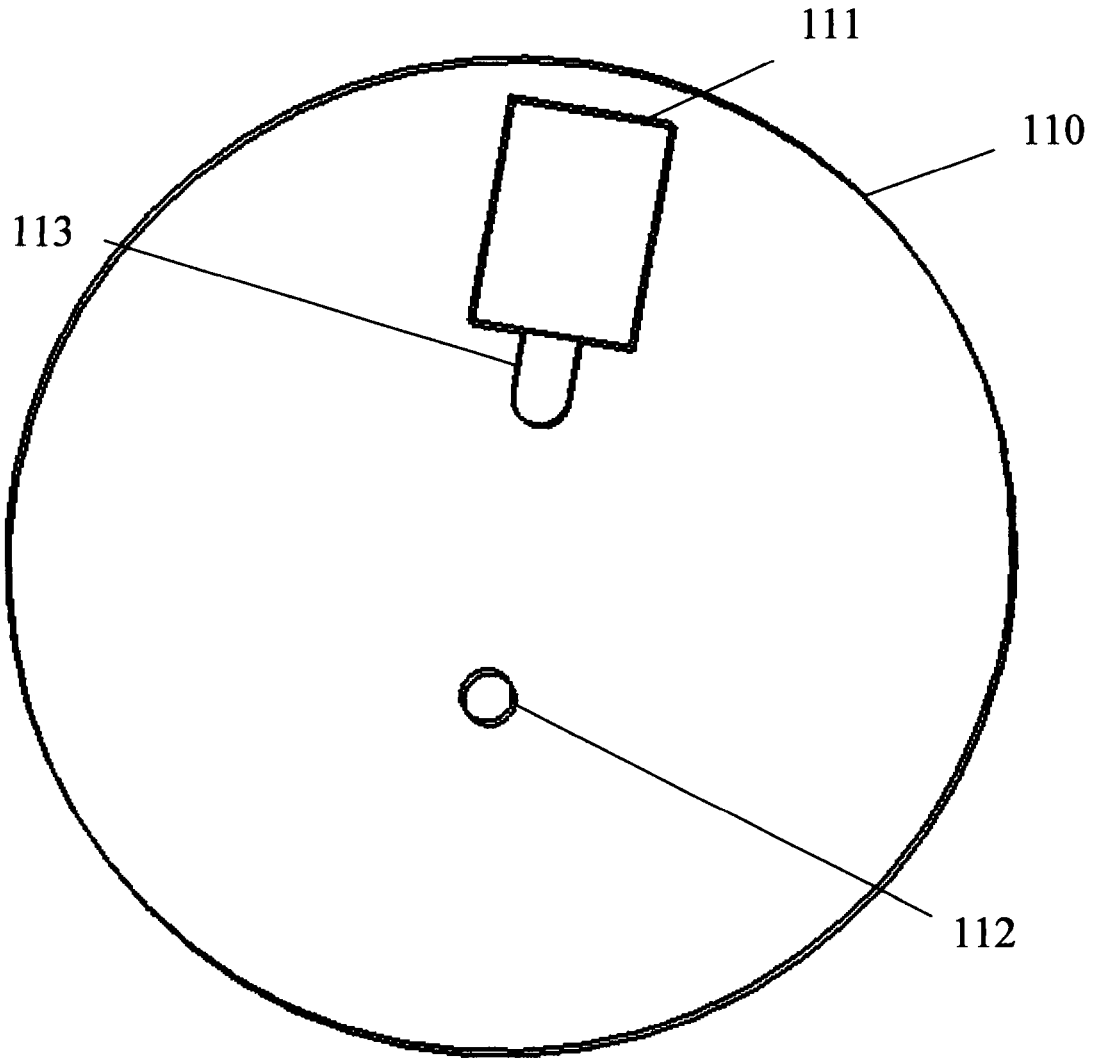
FIG. 1B shows a schematic plan view of the housing of the first embodiment of the counting device according to the invention.
Figure 1C:
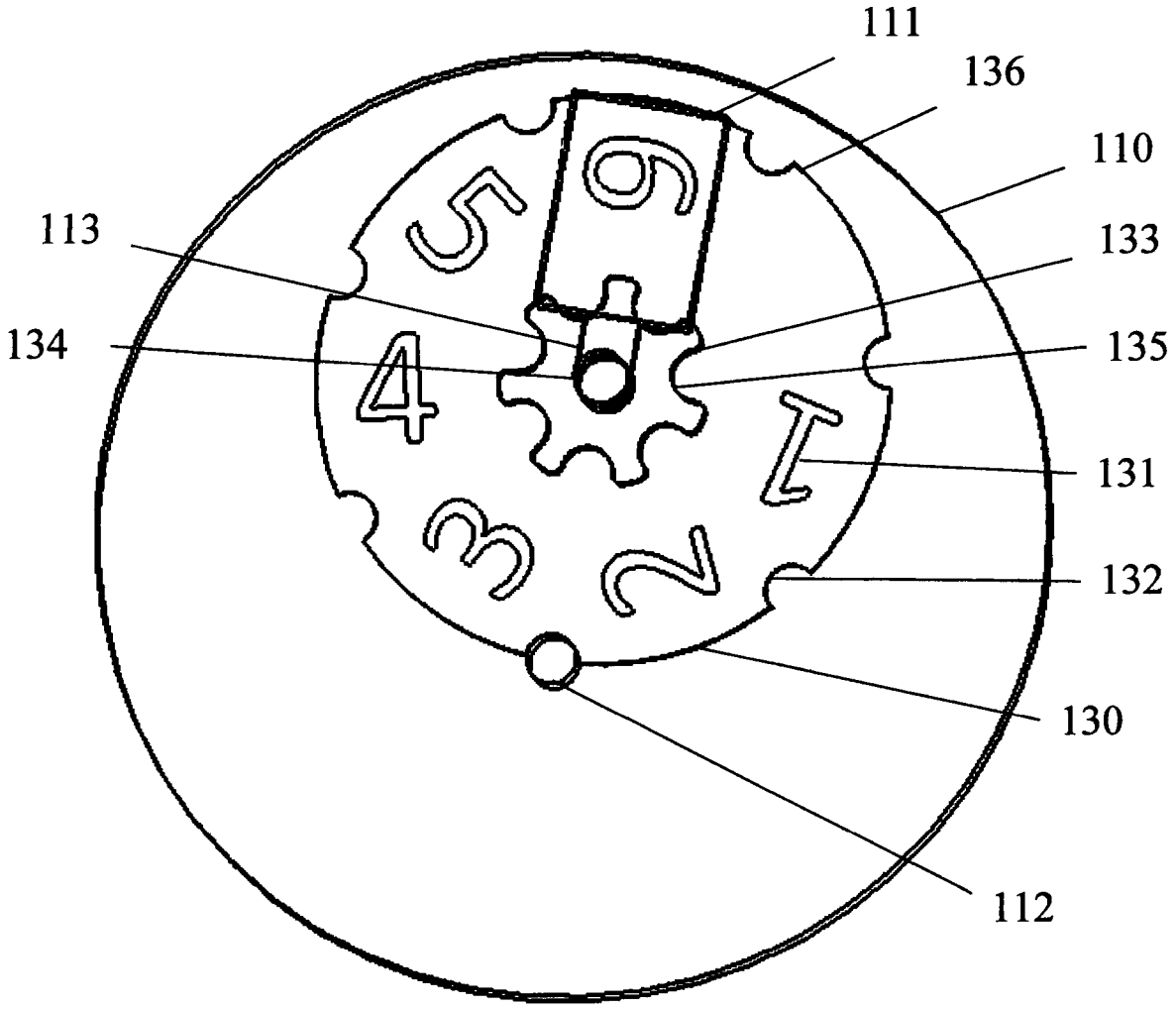
FIG. 1C shows a schematic plan view of the housing and second counting wheel of the first embodiment of the counting device according to the invention.
Figure 1D:
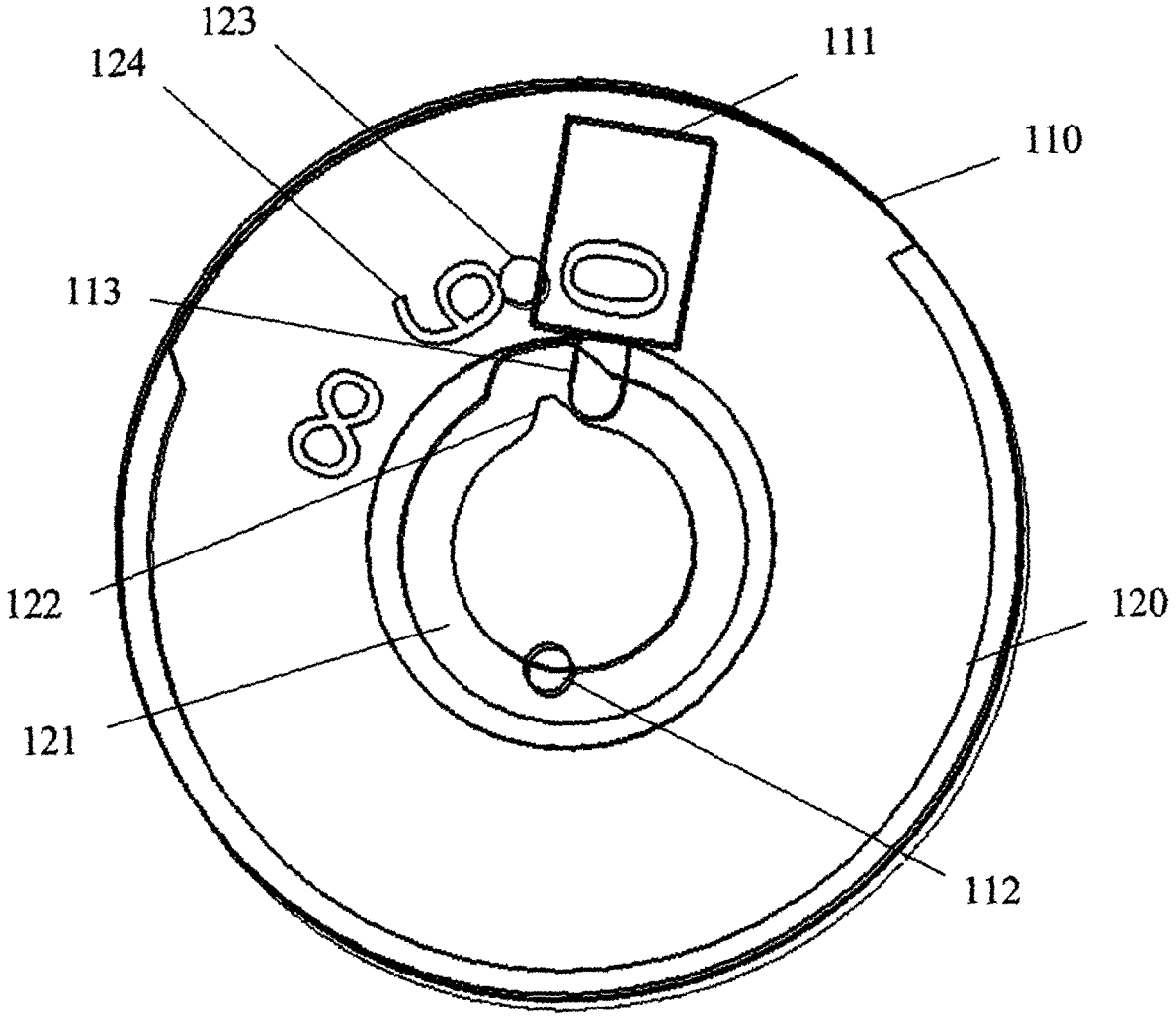
FIG. 1D shows a schematic plan view of the housing and first counting wheel of the first embodiment of the counting device according to the invention.
Figure 1E:
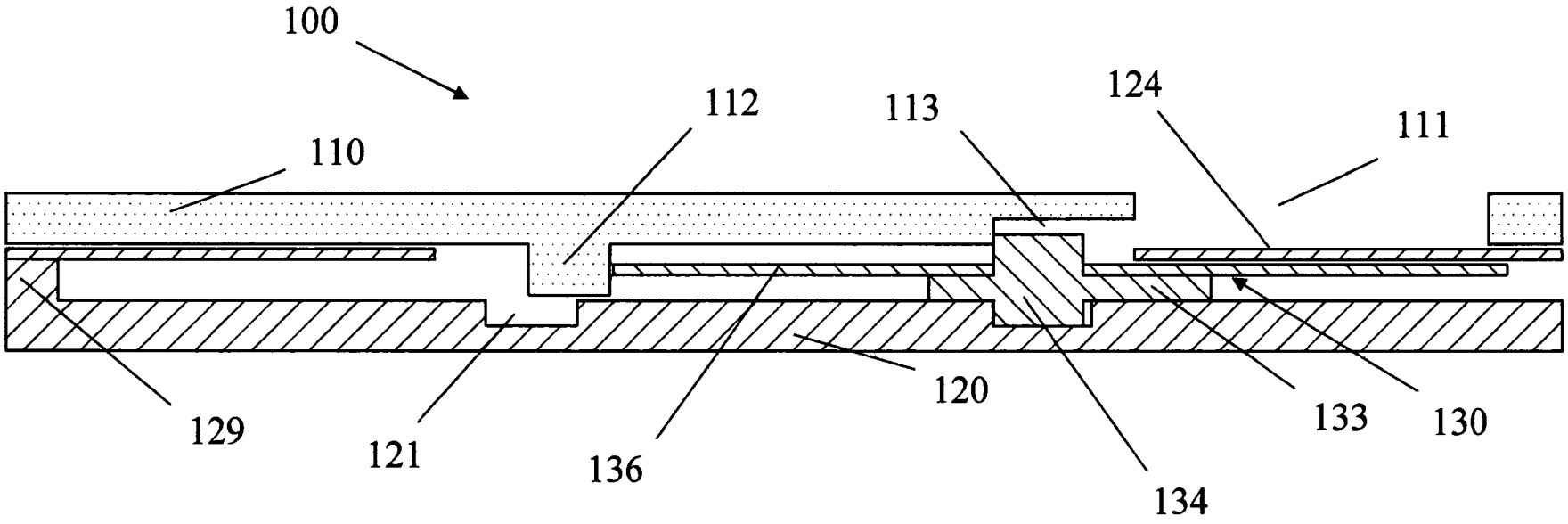
FIG. 1E shows a schematic cross-sectional view of the first embodiment of the counting device according to the invention.
Figure 2A:
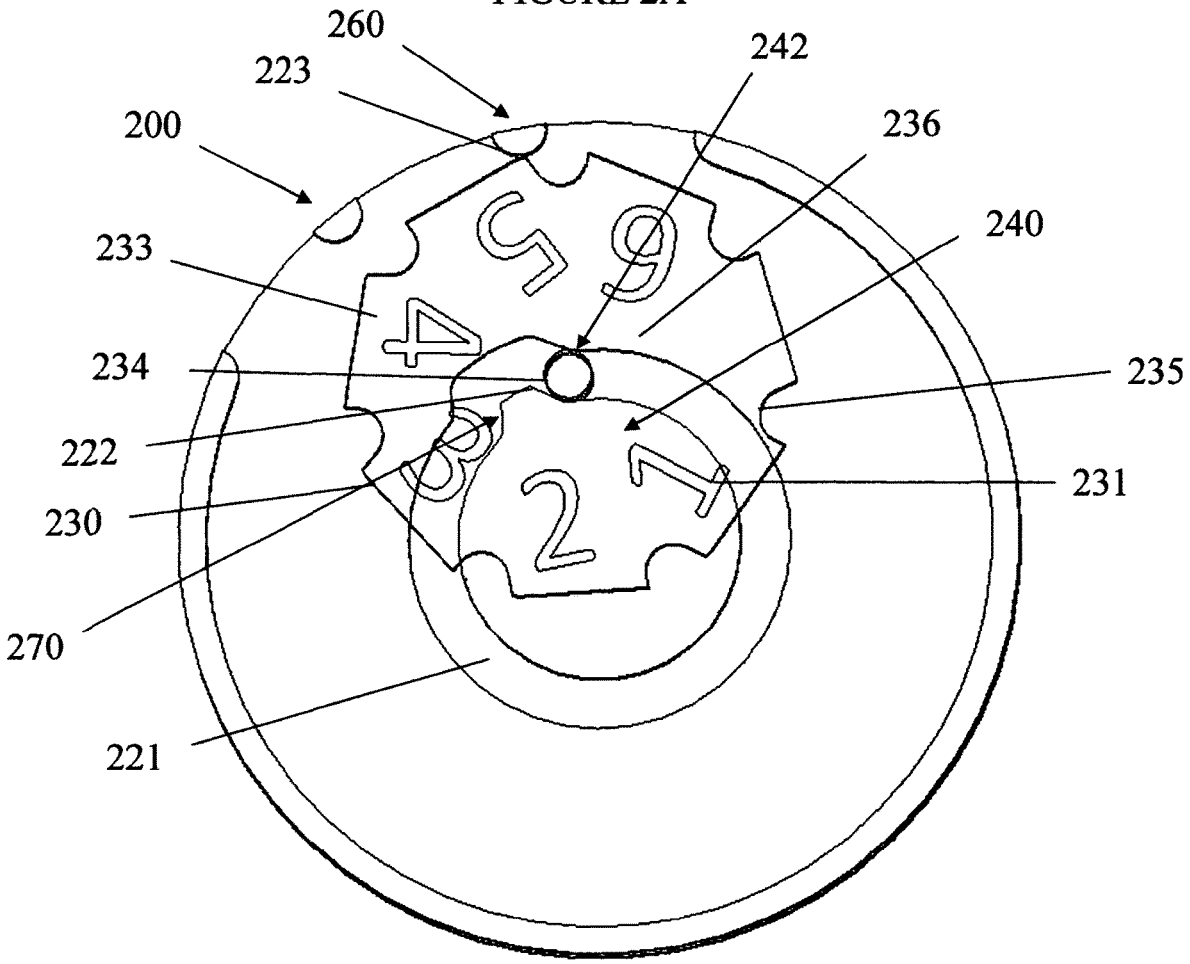
FIG. 2A shows a partial schematic plan view of a second embodiment of a counting device according to the invention.
Figure 2B:
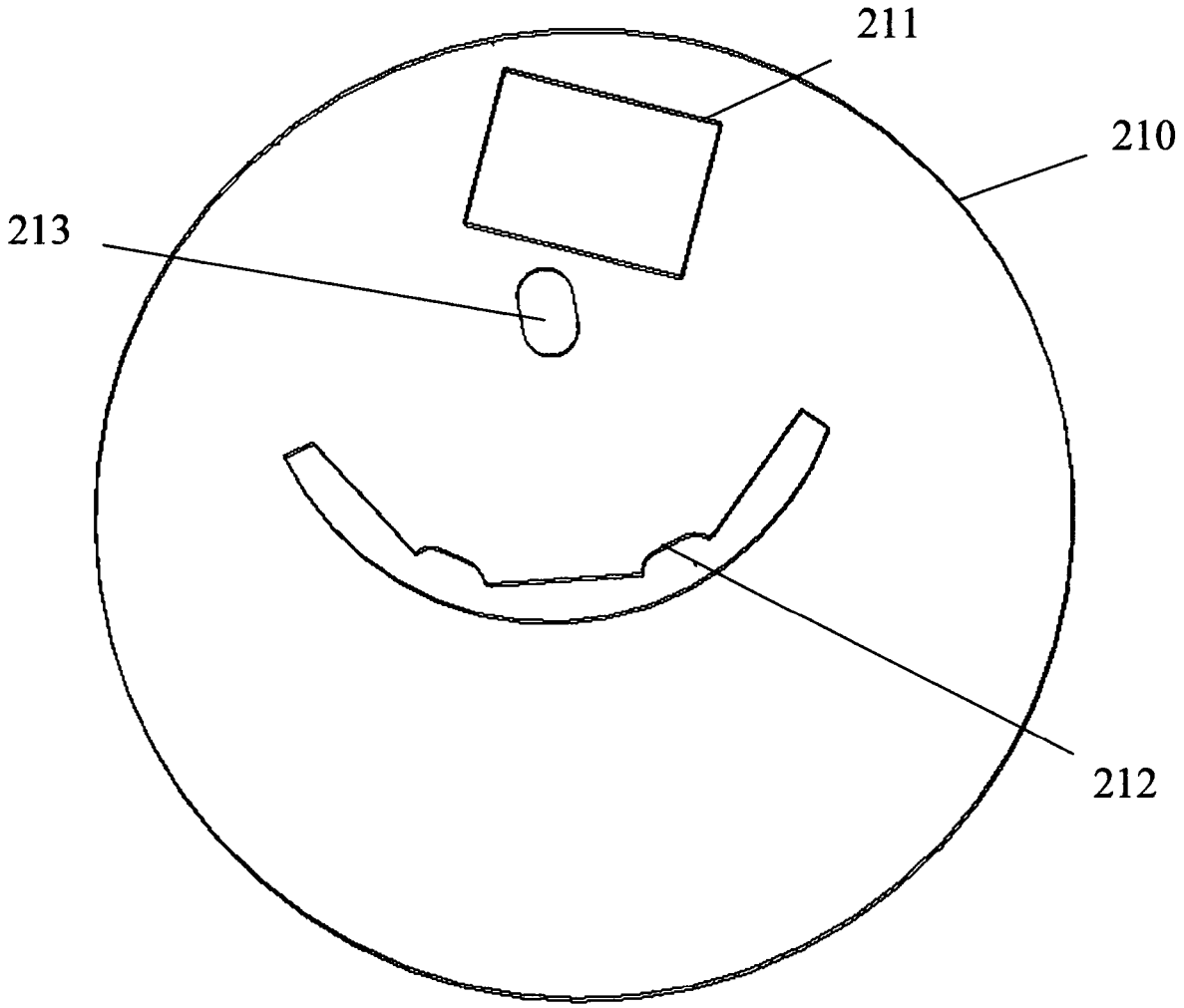
FIG. 2B shows a schematic plan view of the housing of the second embodiment of the counting device according to the invention.
Figure 2C:
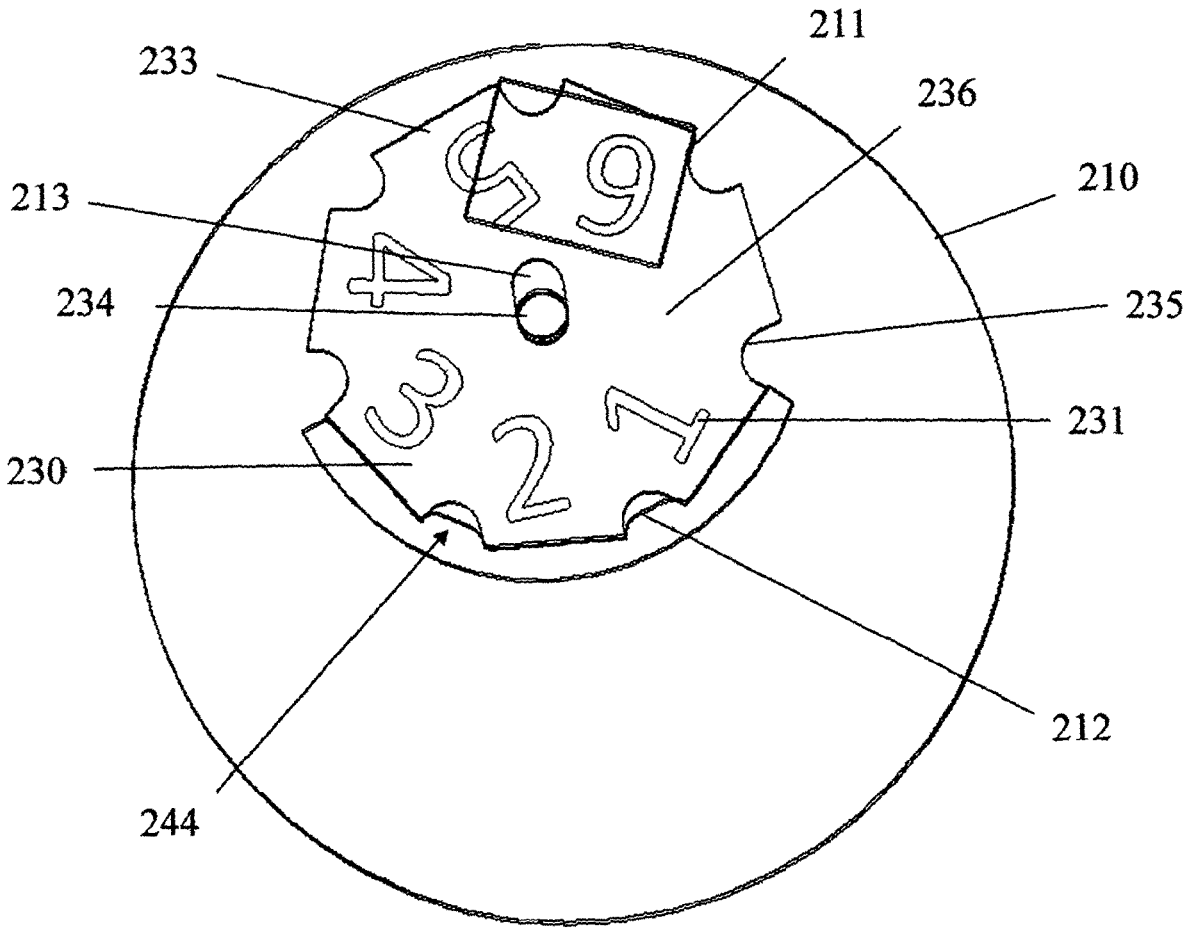
FIG. 2C shows a schematic plan view of the housing and second counting wheel of the second embodiment of the counting device according to the invention.
Figure 2D:
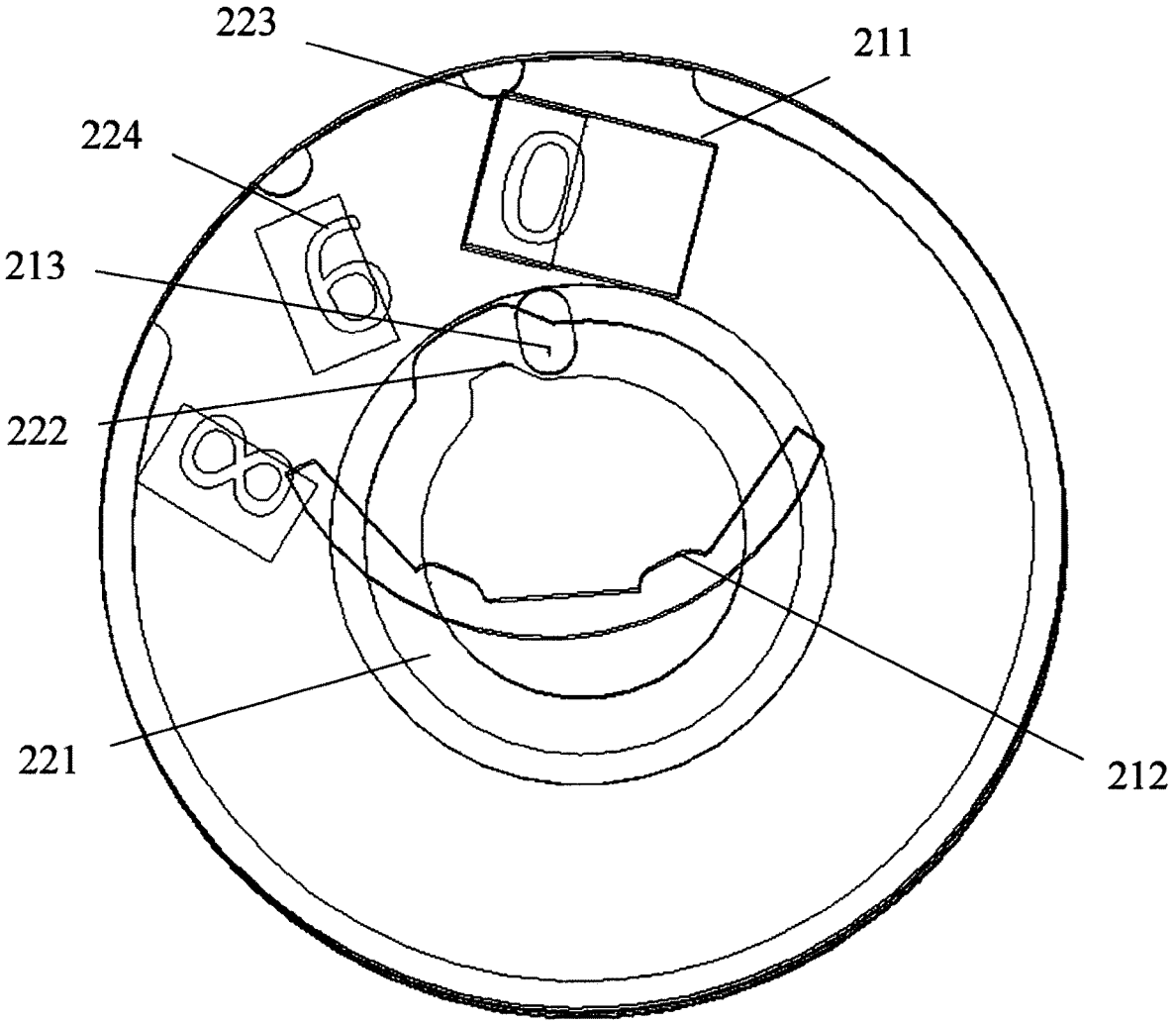
FIG. 2D shows a schematic plan view of the housing and first counting wheel of the second embodiment of the counting device according to the invention.
Figure 2E:
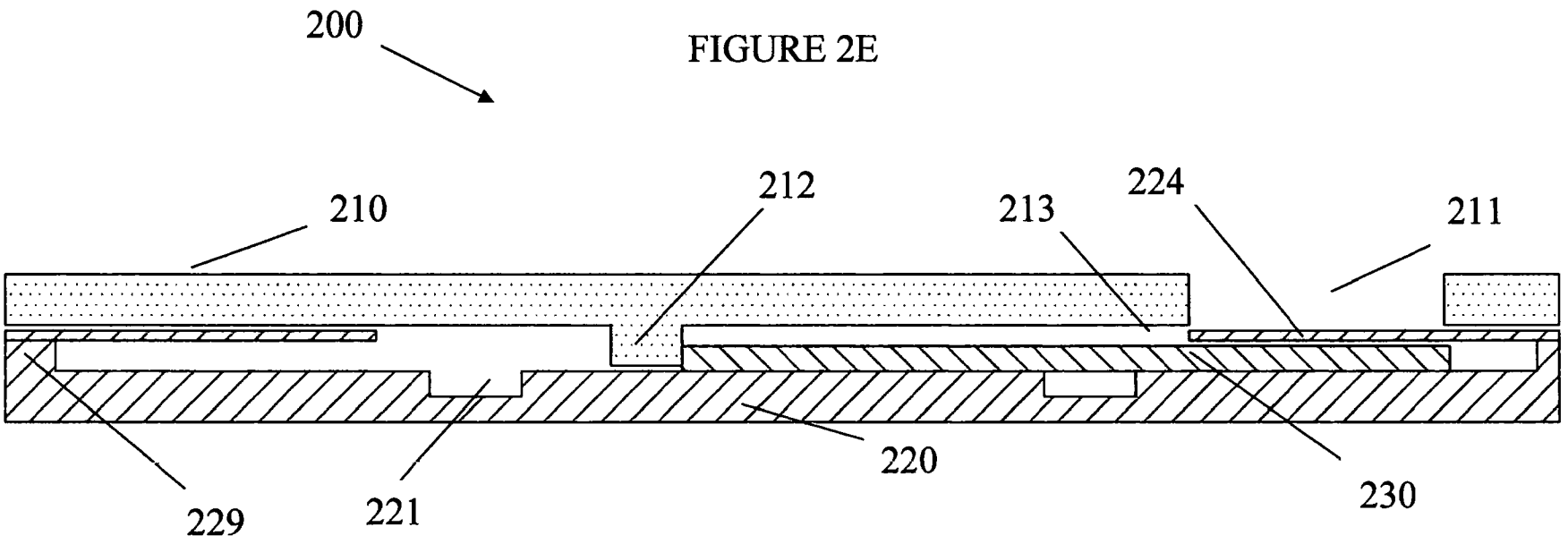
FIG. 2E shows a schematic cross-sectional view of the second embodiment of the counting device according to the invention.
Figure 3A:
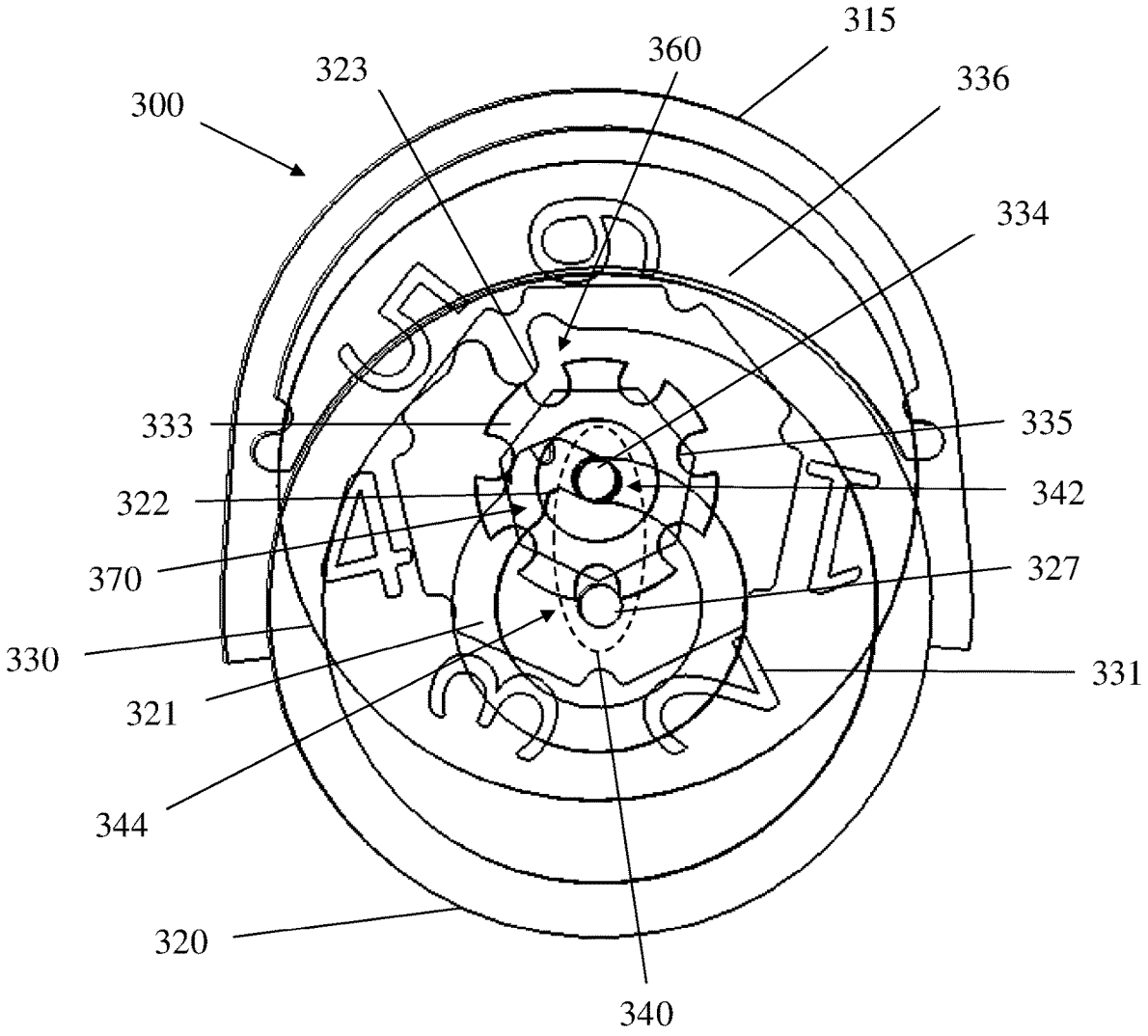
FIG. 3A shows a partial schematic plan view of a third embodiment of a counting device according to the invention.
Figure 3B:
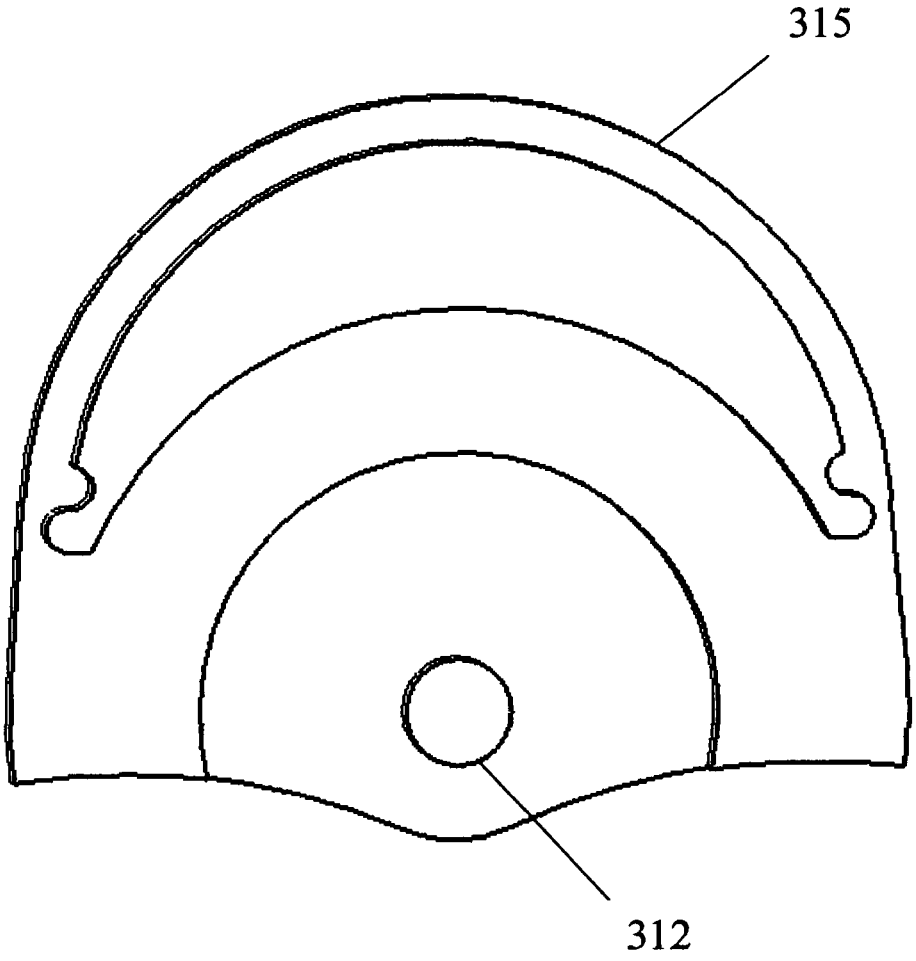
FIG. 3B shows a schematic plan view of the housing of the third embodiment of the counting device according to the invention.
Figure 3C:
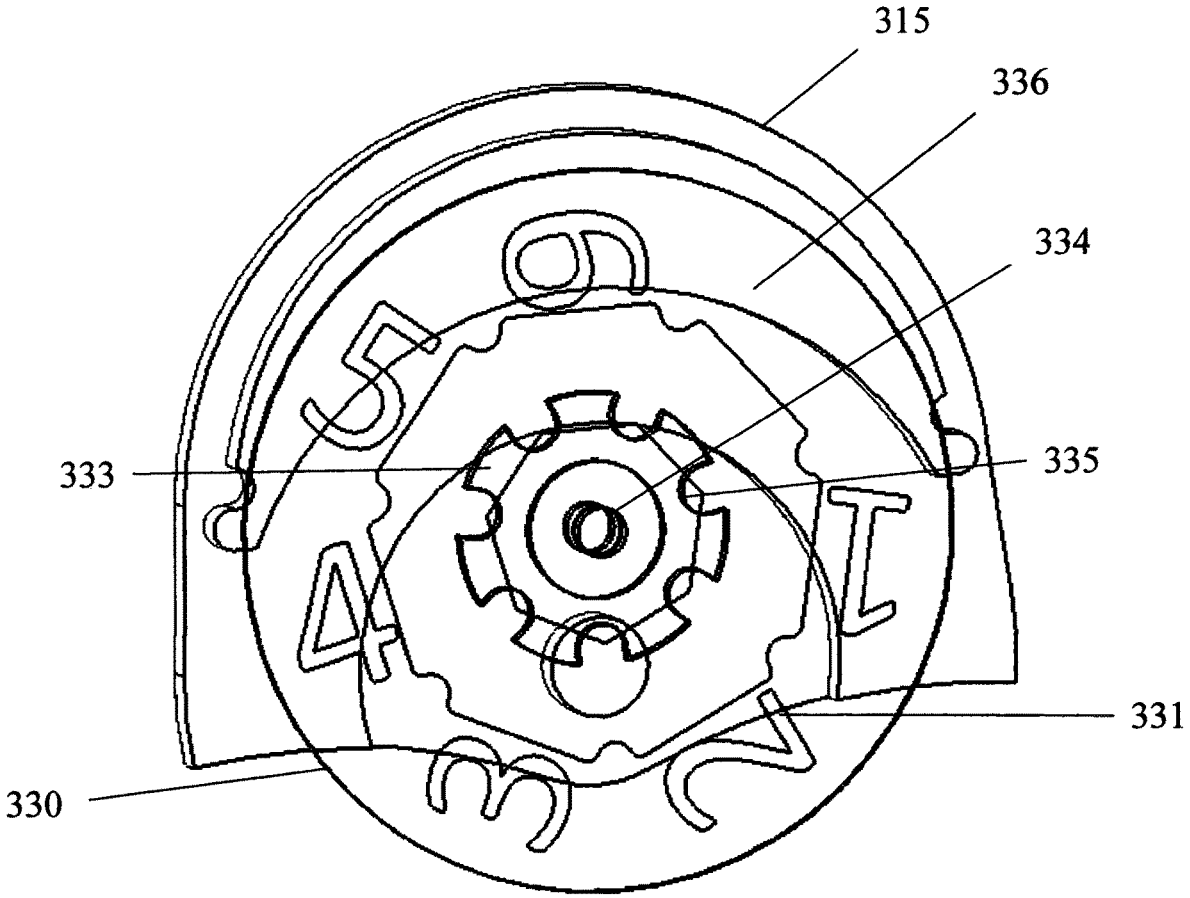
FIG. 3C shows a schematic plan view of the housing and second counting wheel of the third embodiment of the counting device according to the invention.
Figure 3D:
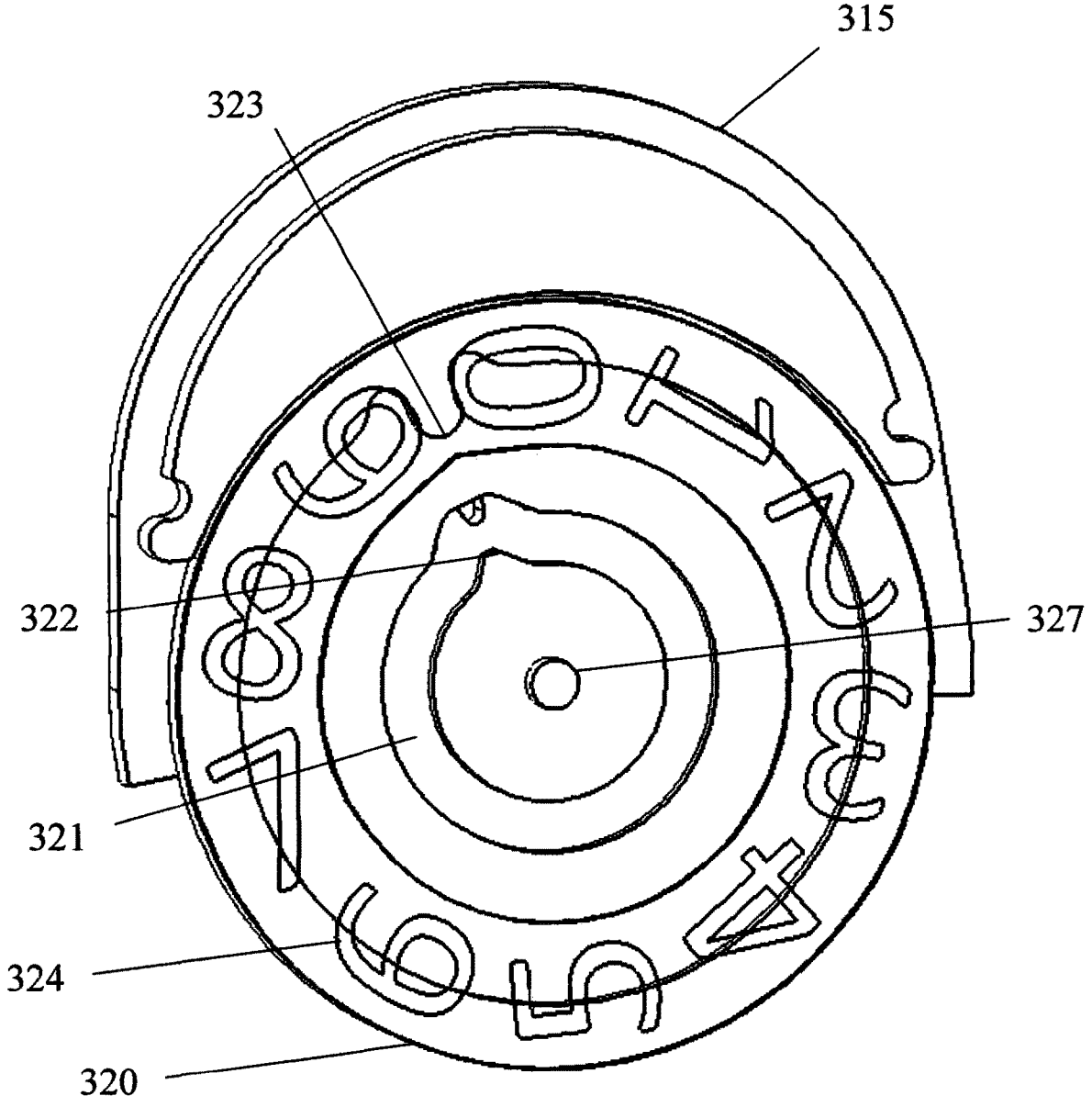
FIG. 3D shows a schematic plan view of the housing and first counting wheel of the third embodiment of the counting device according to the invention.
Figure 3E:
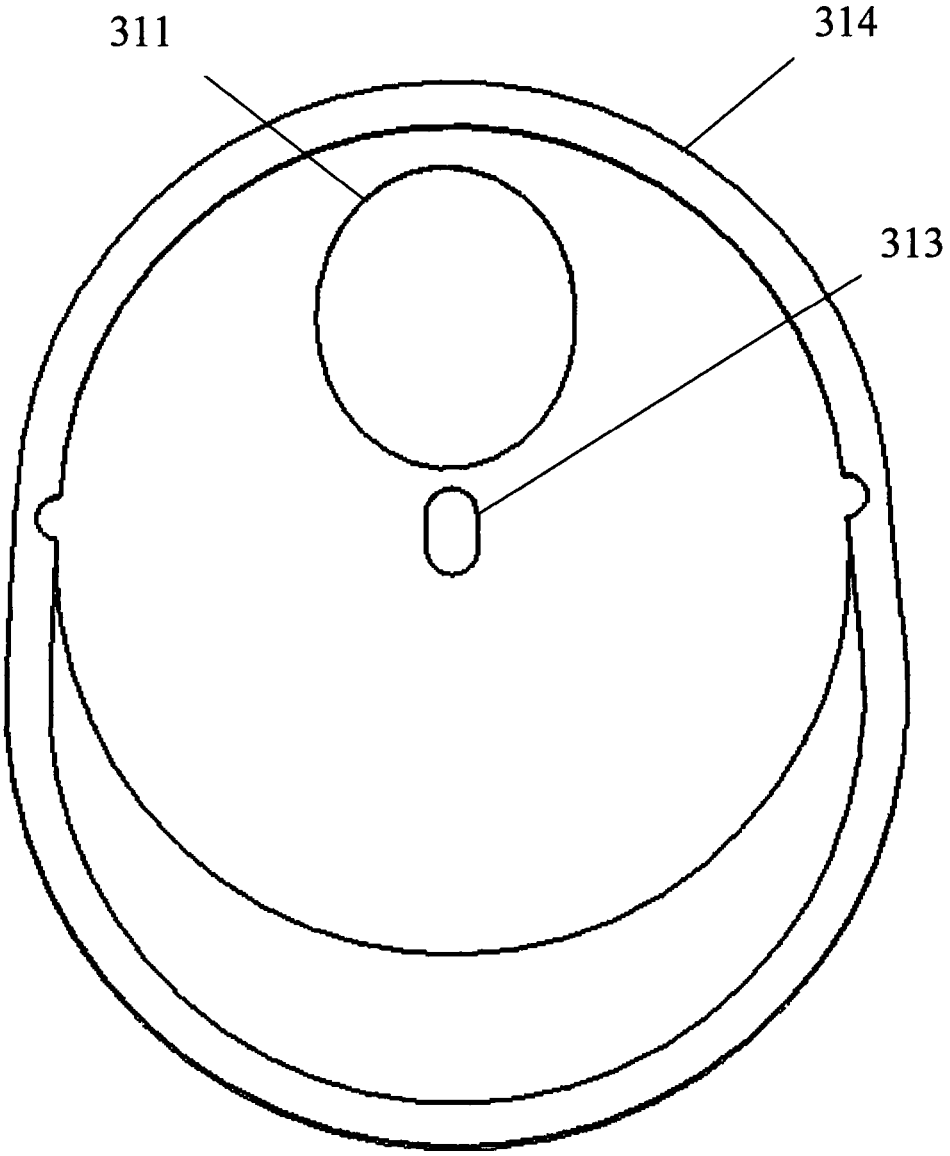
FIG. 3E shows a schematic plan view of the rear side of the housing of the third embodiment of the counting device according to the invention.
Figure 3F:
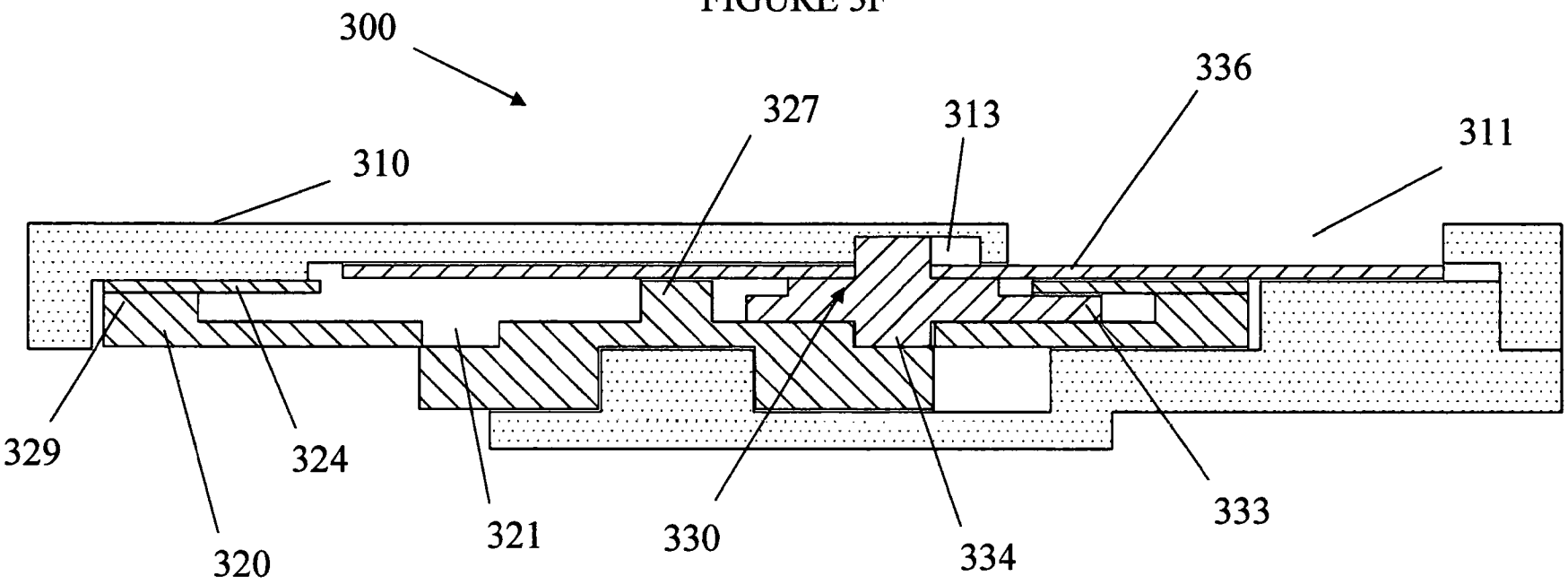
FIG. 3F shows a schematic cross-sectional view of the third embodiment of the counting device according to the invention.
Figure 4A:
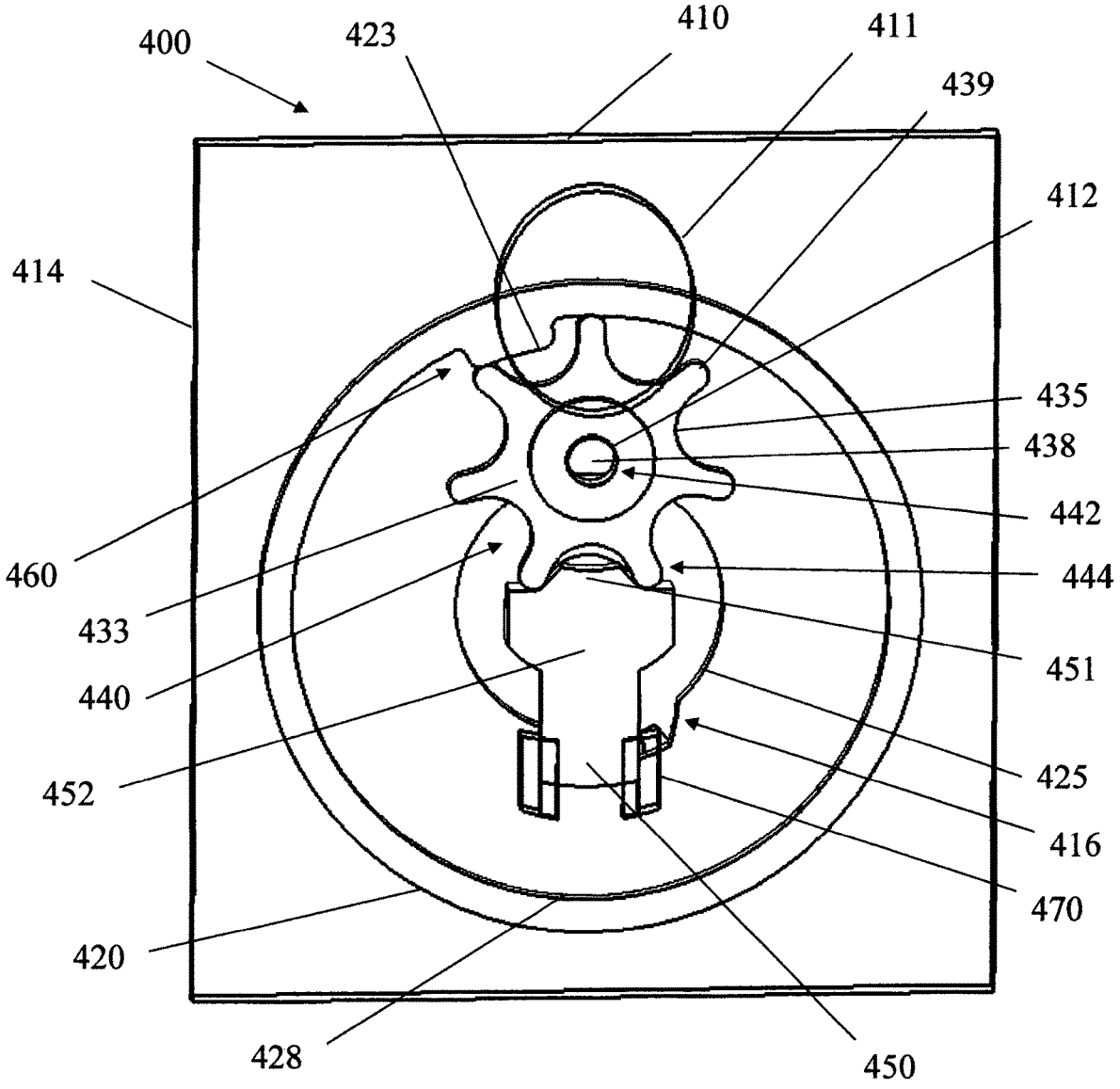
FIG. 4A shows a partial schematic plan view of a fourth embodiment of a counting device according to the invention.
Figure 4B:
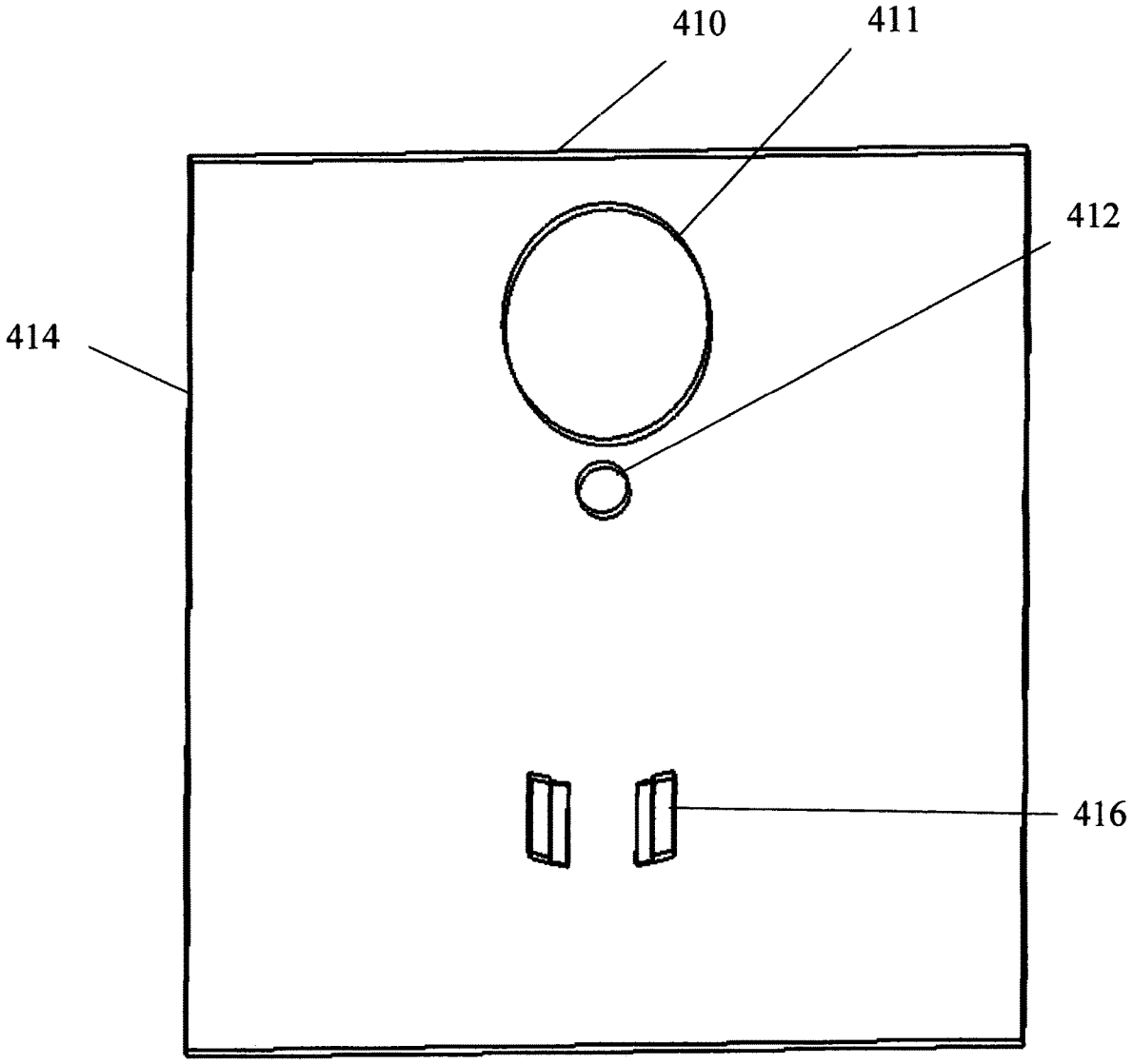
FIG. 4B shows a schematic plan view of the housing of the fourth embodiment of the counting device according to the invention.
Figure 4C:
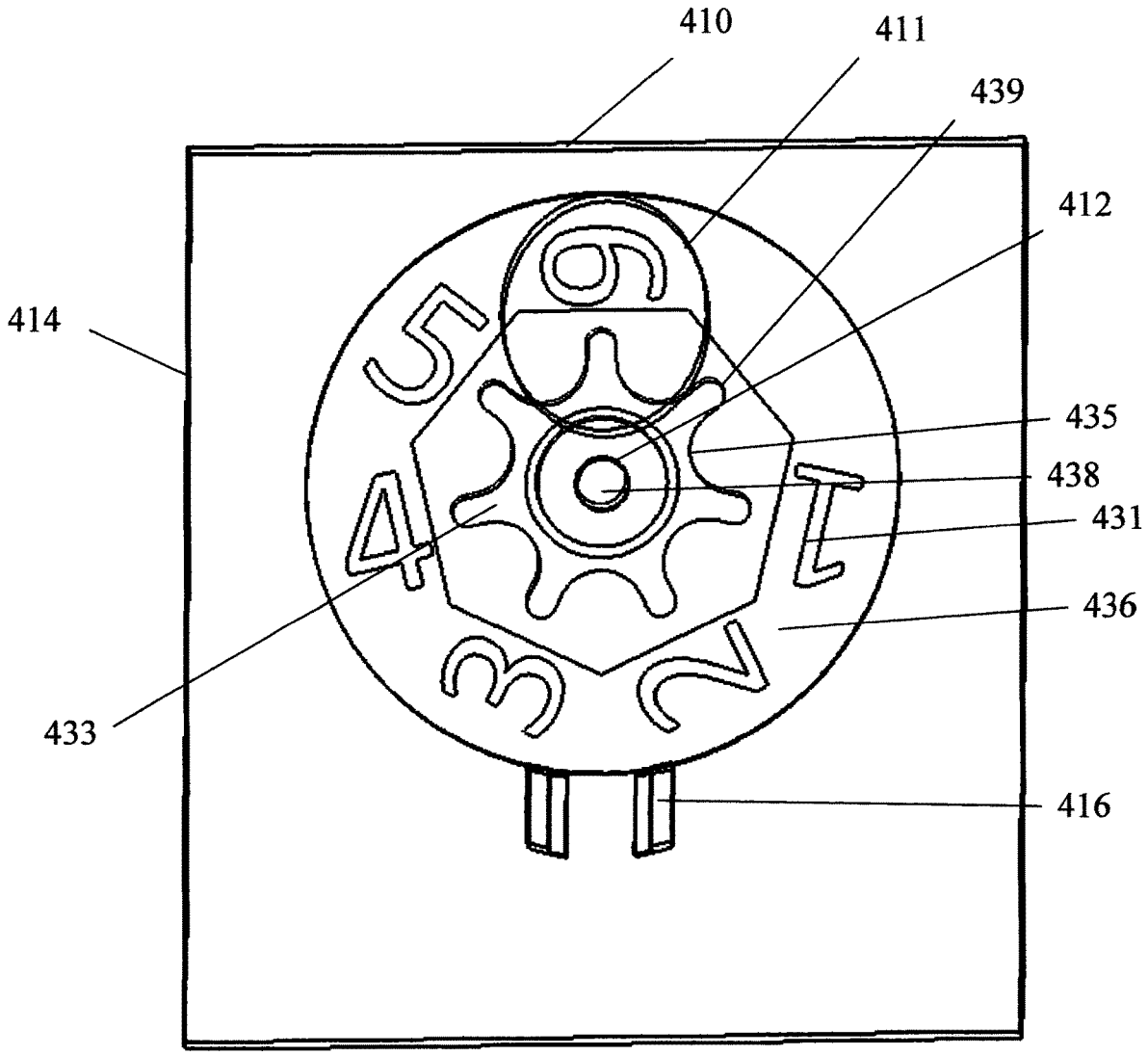
FIG. 4C shows a schematic plan view of the housing and second counting wheel of the fourth embodiment of the counting device according to the invention.
Figure 4D:
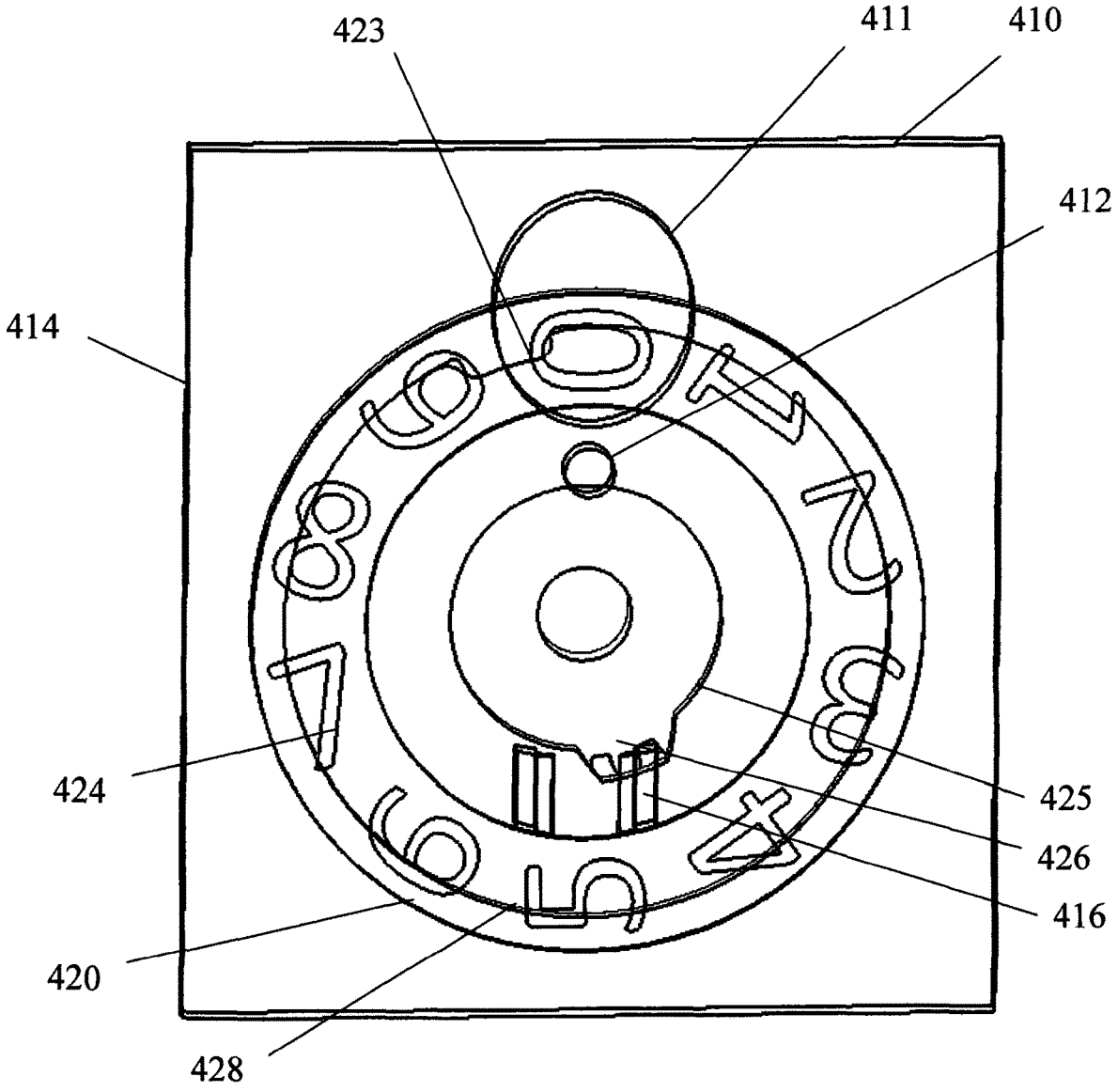
FIG. 4D shows a schematic plan view of the housing and first counting wheel of the fourth embodiment of the counting device according to the invention.
Figure 4E:
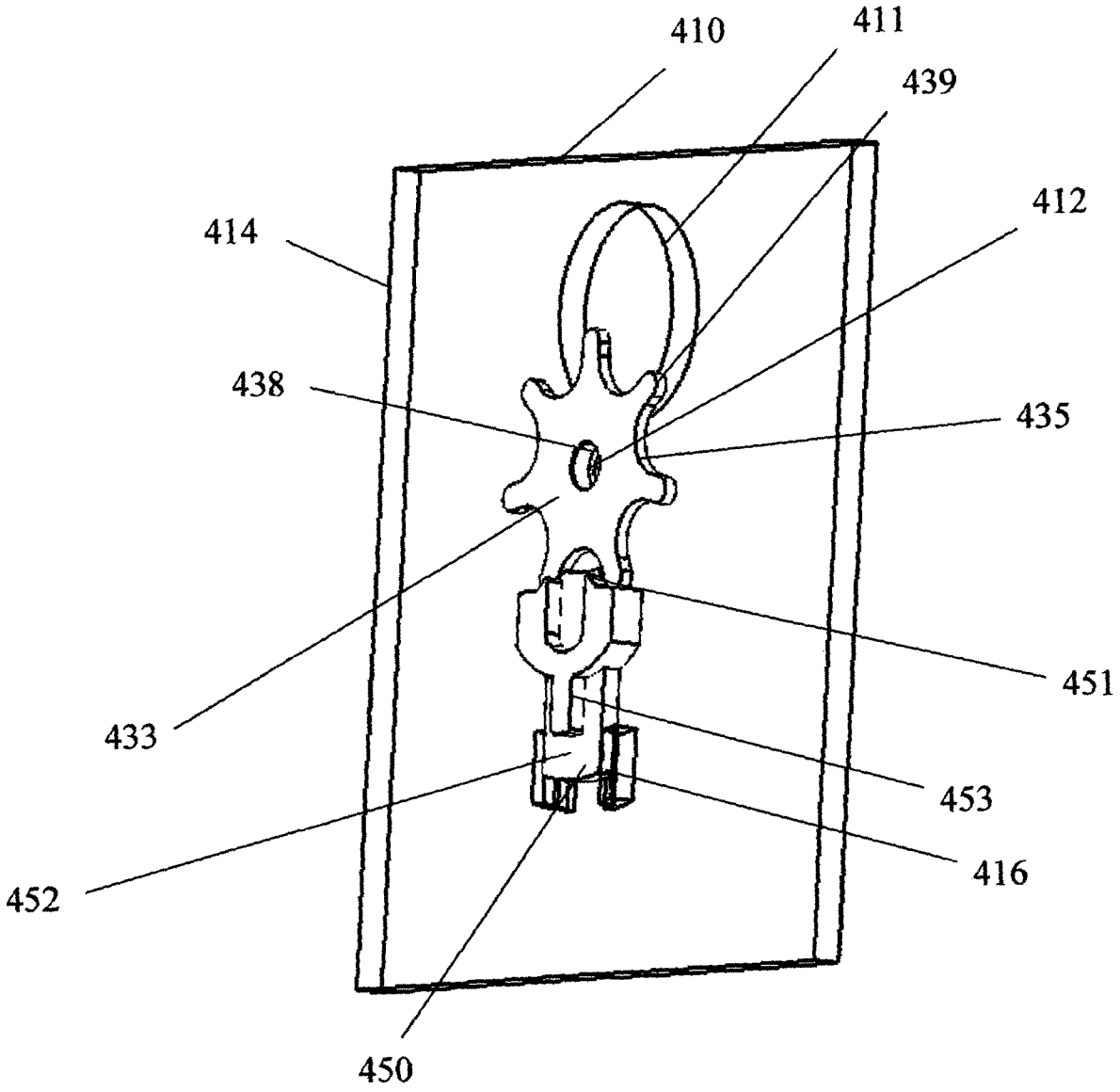
FIG. 4E shows a schematic plan view of the rear side of the housing, part of the second counting wheel and the lock of the fourth embodiment of the counting device according to the invention.
Figure 4F:
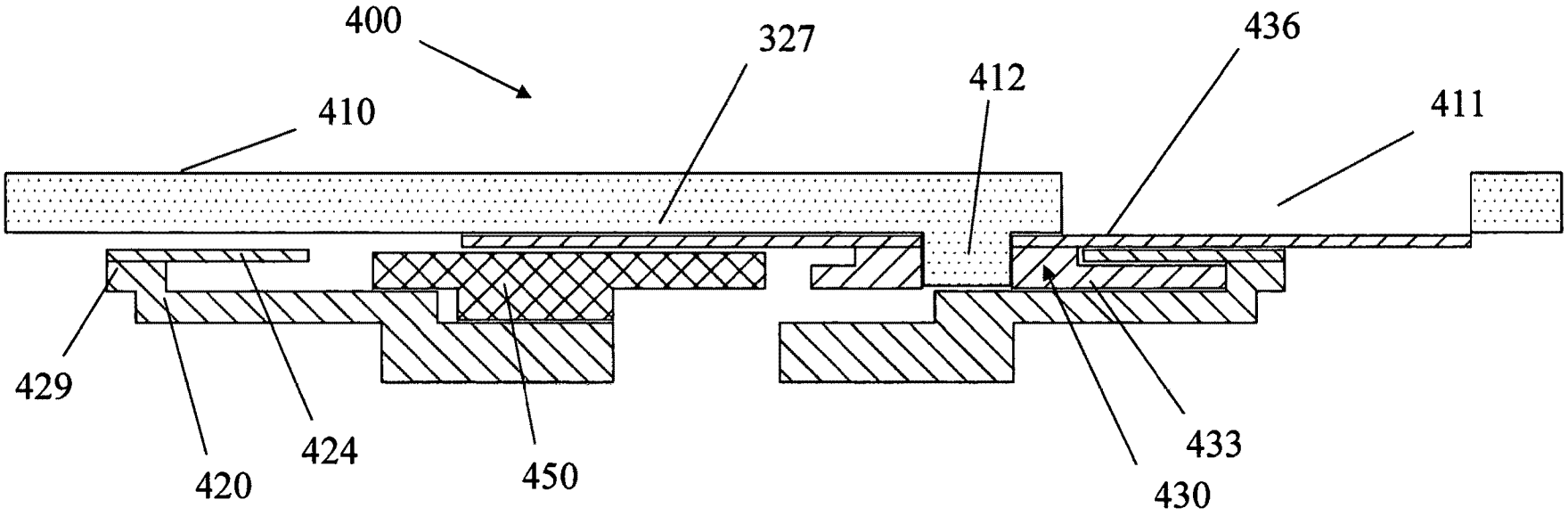
FIG. 4F shows a schematic cross-sectional view of the fourth embodiment of the counting device according to the invention.
Figure 5A:
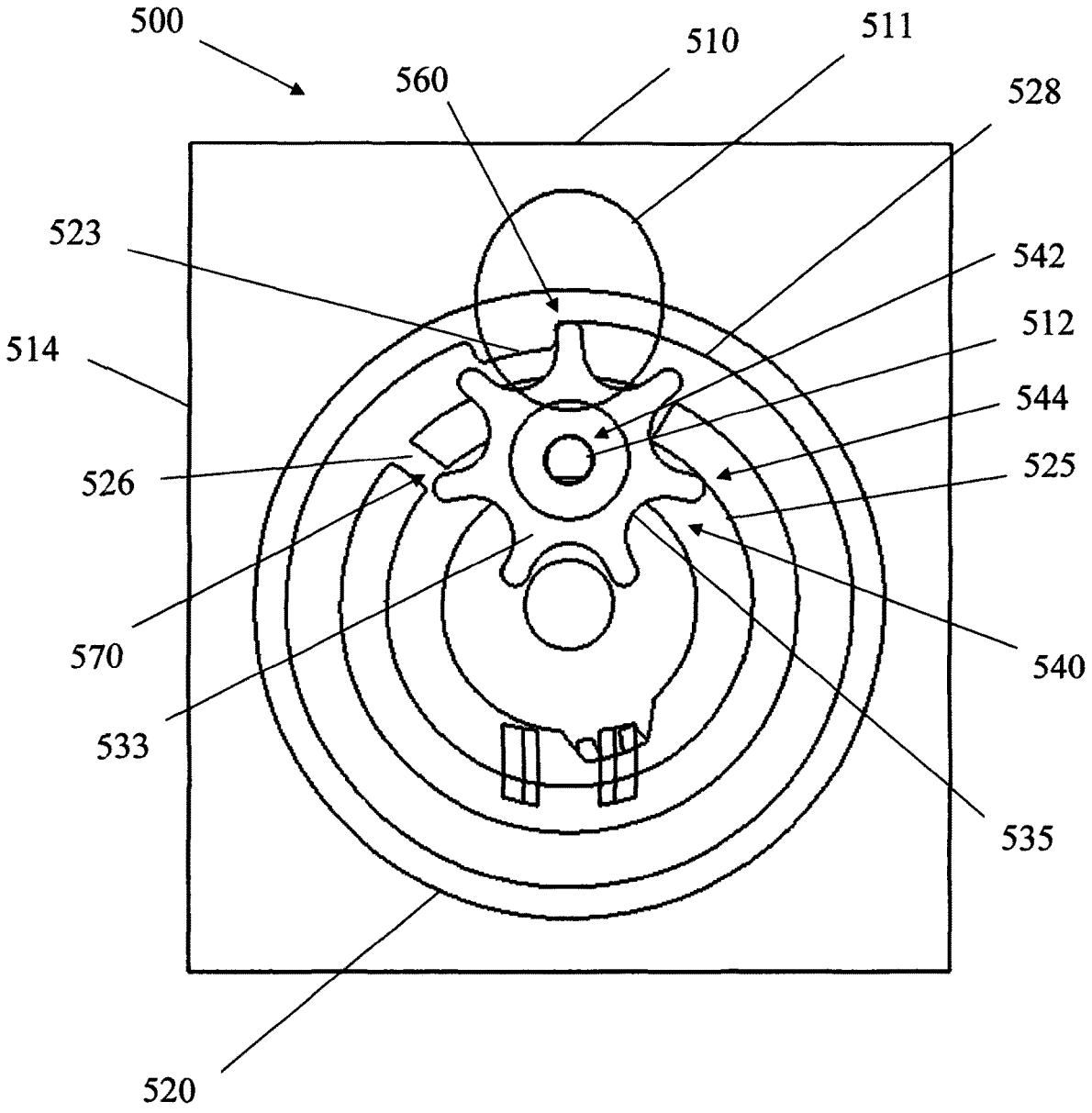
FIG. 5A shows a partial schematic plan view of a fifth embodiment of a counting device according to the invention.
Figure 5B:
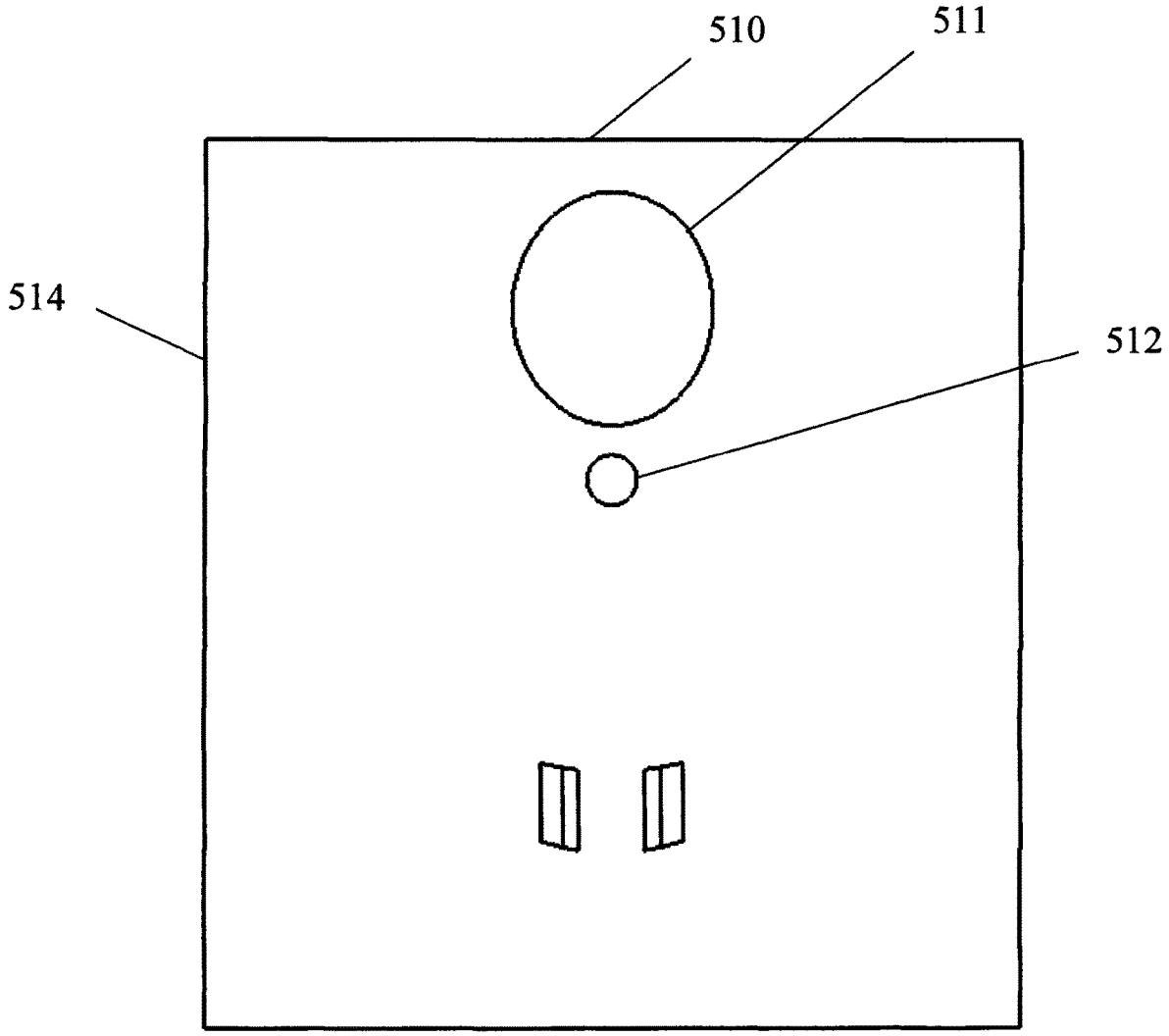
FIG. 5B shows a schematic plan view of the housing of the fifth embodiment of the counting device according to the invention.
Figure 5C:
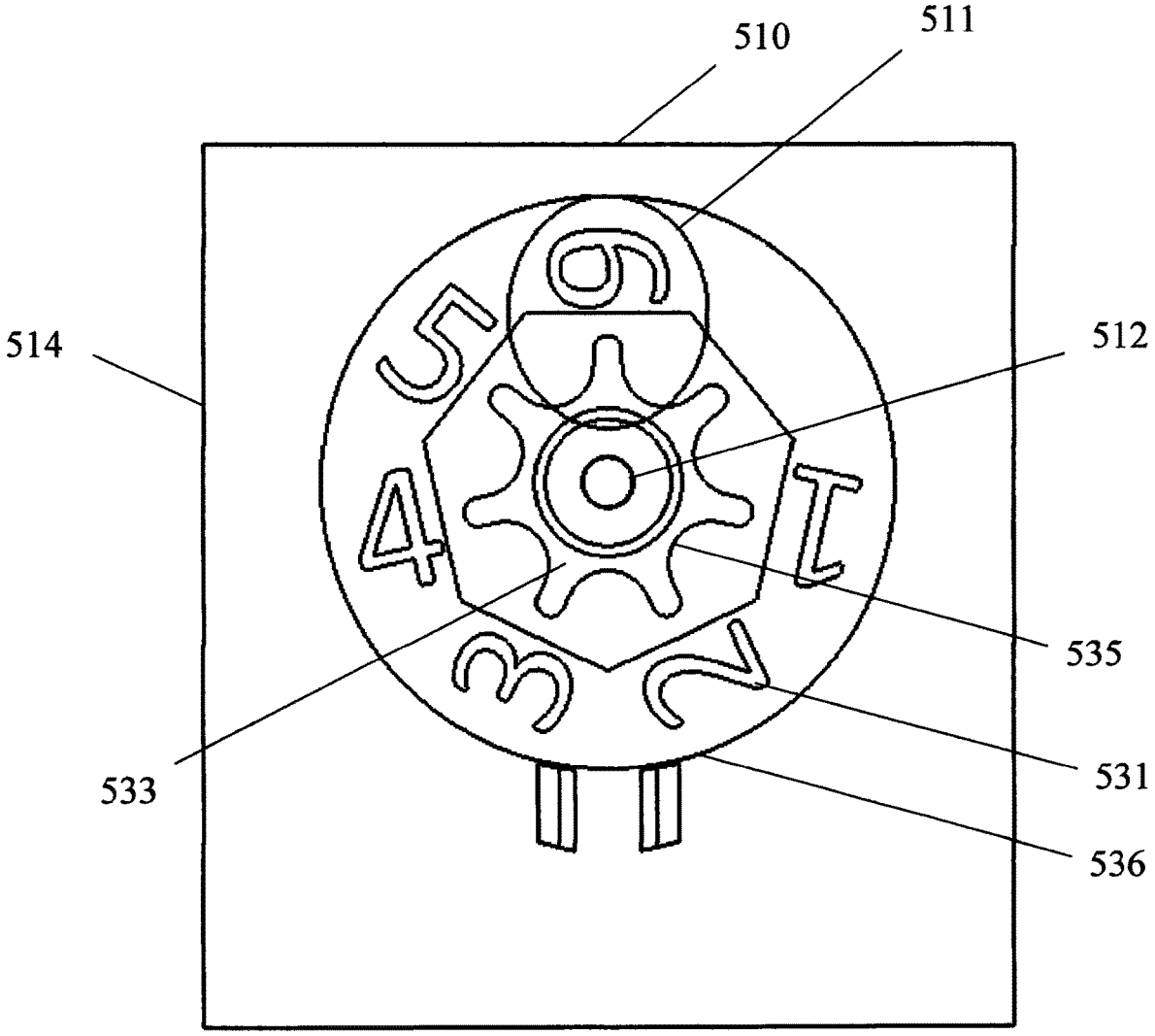
FIG. 5C shows a schematic plan view of the housing and second counting wheel of the fifth embodiment of the counting device according to the invention.
Figure 5D:
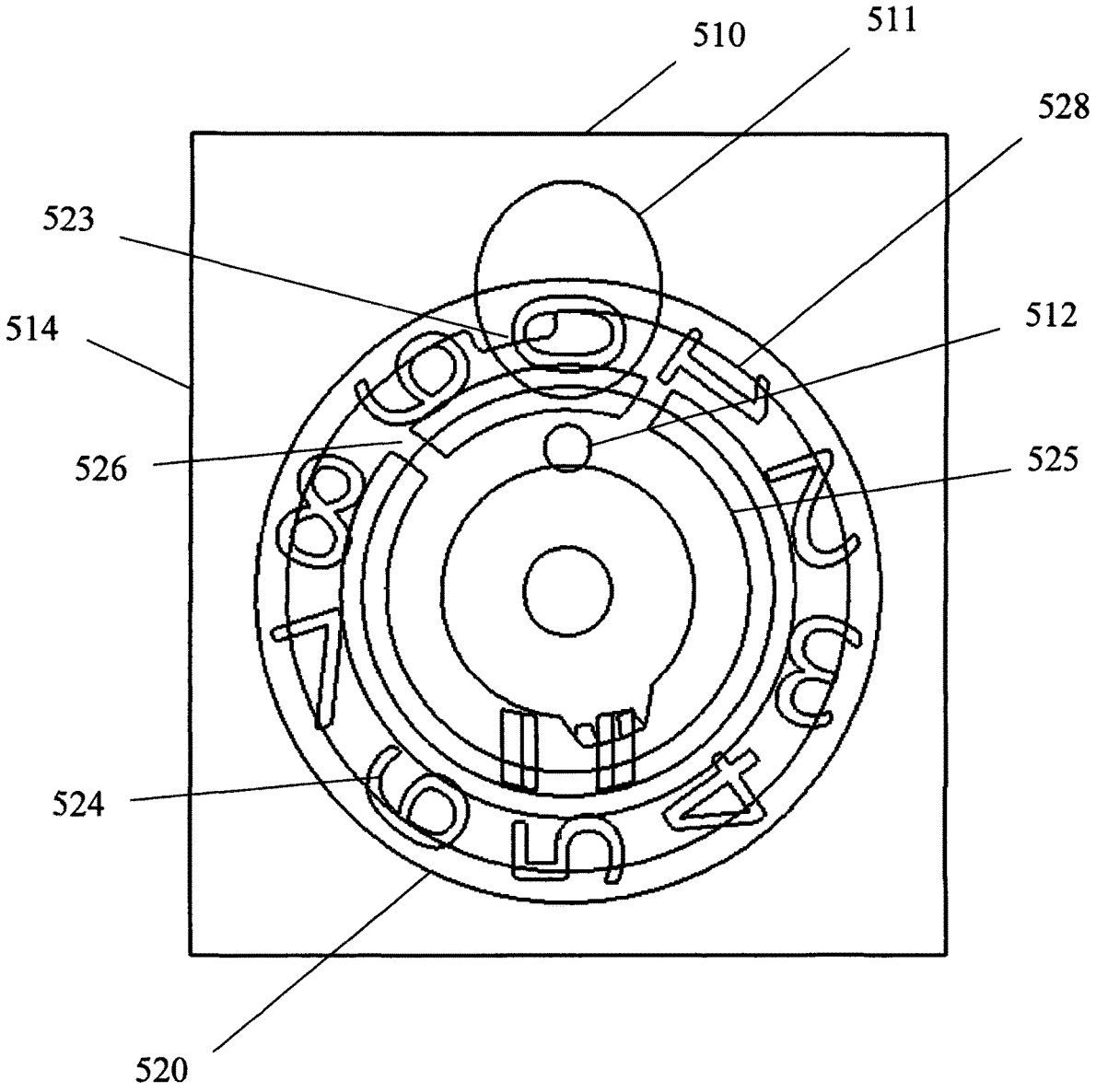
FIG. 5D shows a schematic plan view of the housing and first counting wheel of the fifth embodiment of the counting device according to the invention.
Figure 5E:
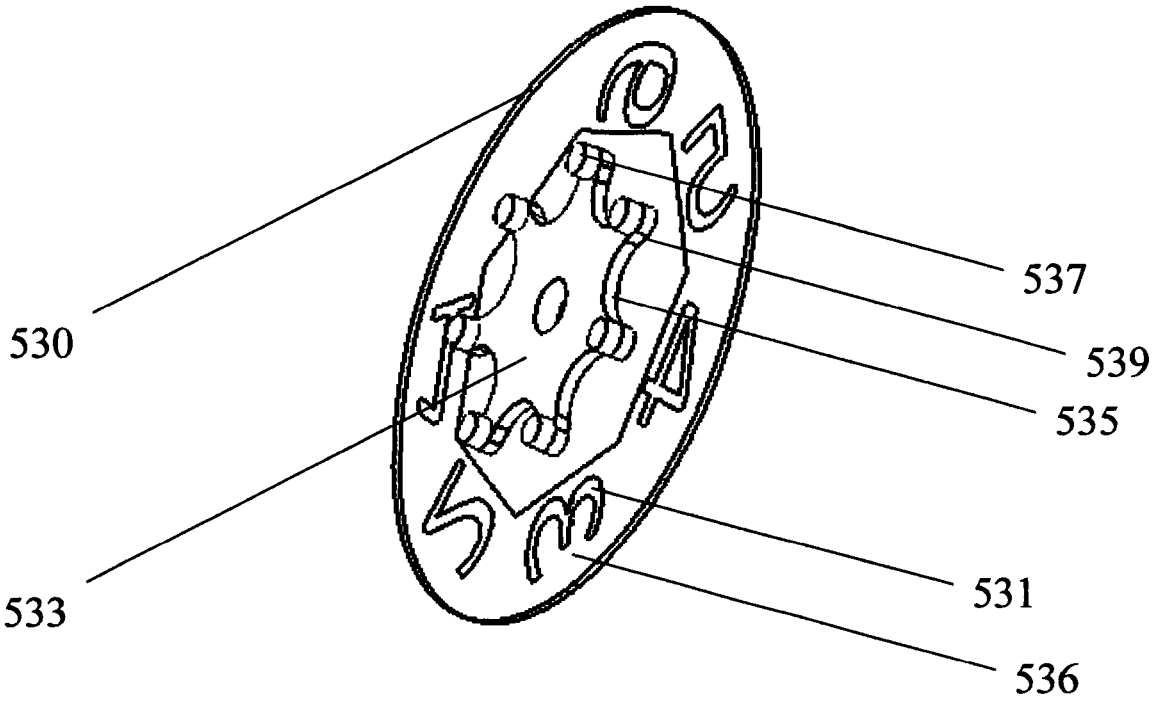
FIG. 5E shows a schematic perspective view of the rear side of the second counting wheel of the fifth embodiment of the counting device according to the invention.
Figure 5F:
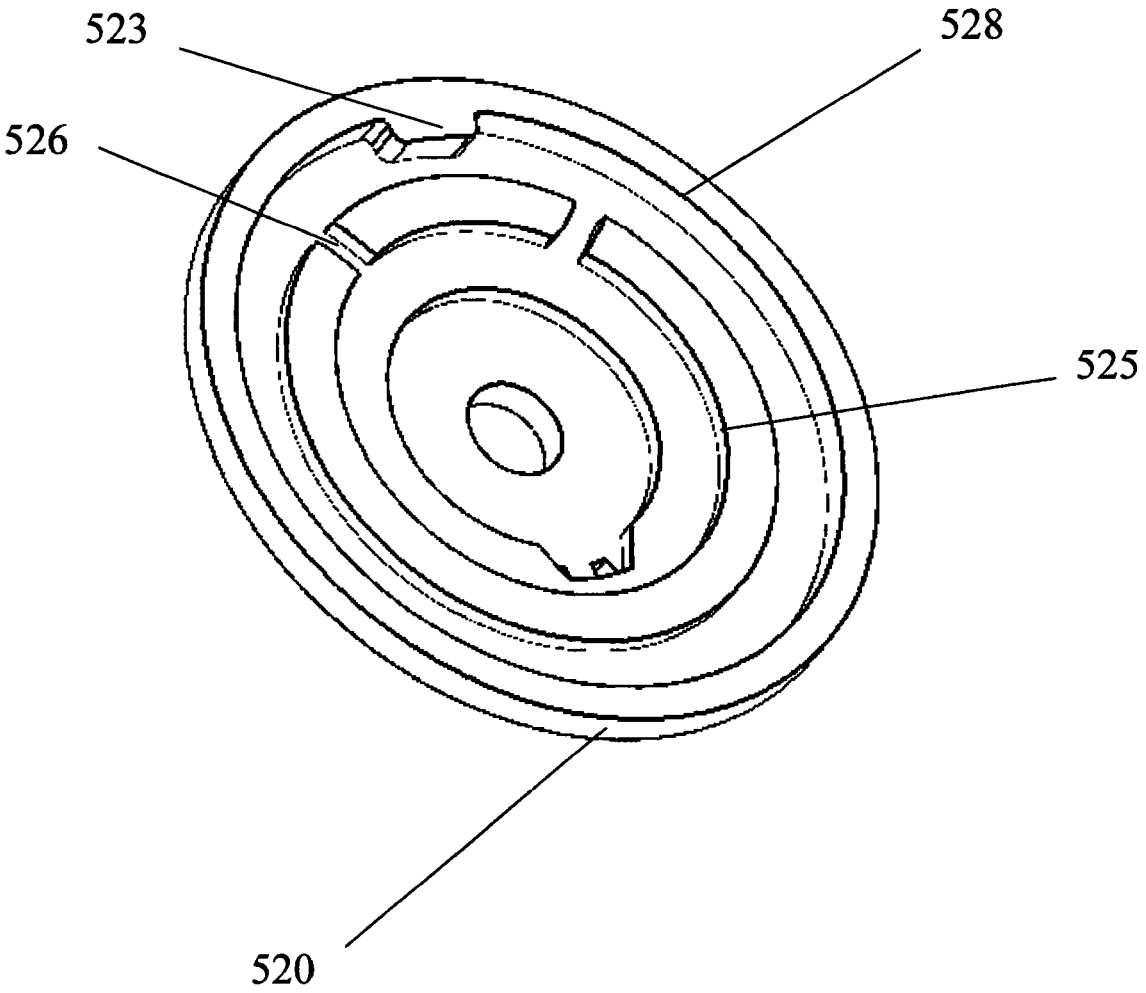
FIG. 5F shows a schematic perspective view of the front side of the first counting wheel of the fifth embodiment of the counting device according to the invention.
Figure 5G:
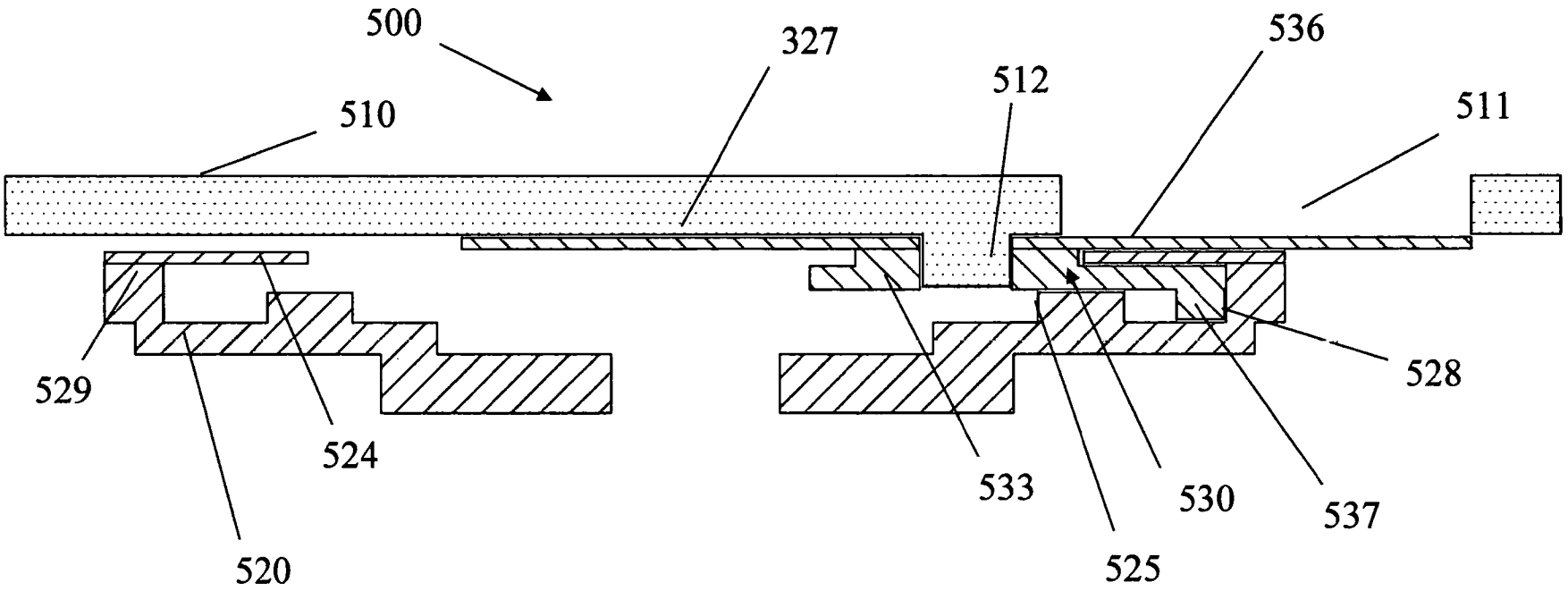
FIG. 5G shows a schematic cross-sectional view of the fifth embodiment of the counting device according to the invention.
Figure 6A:
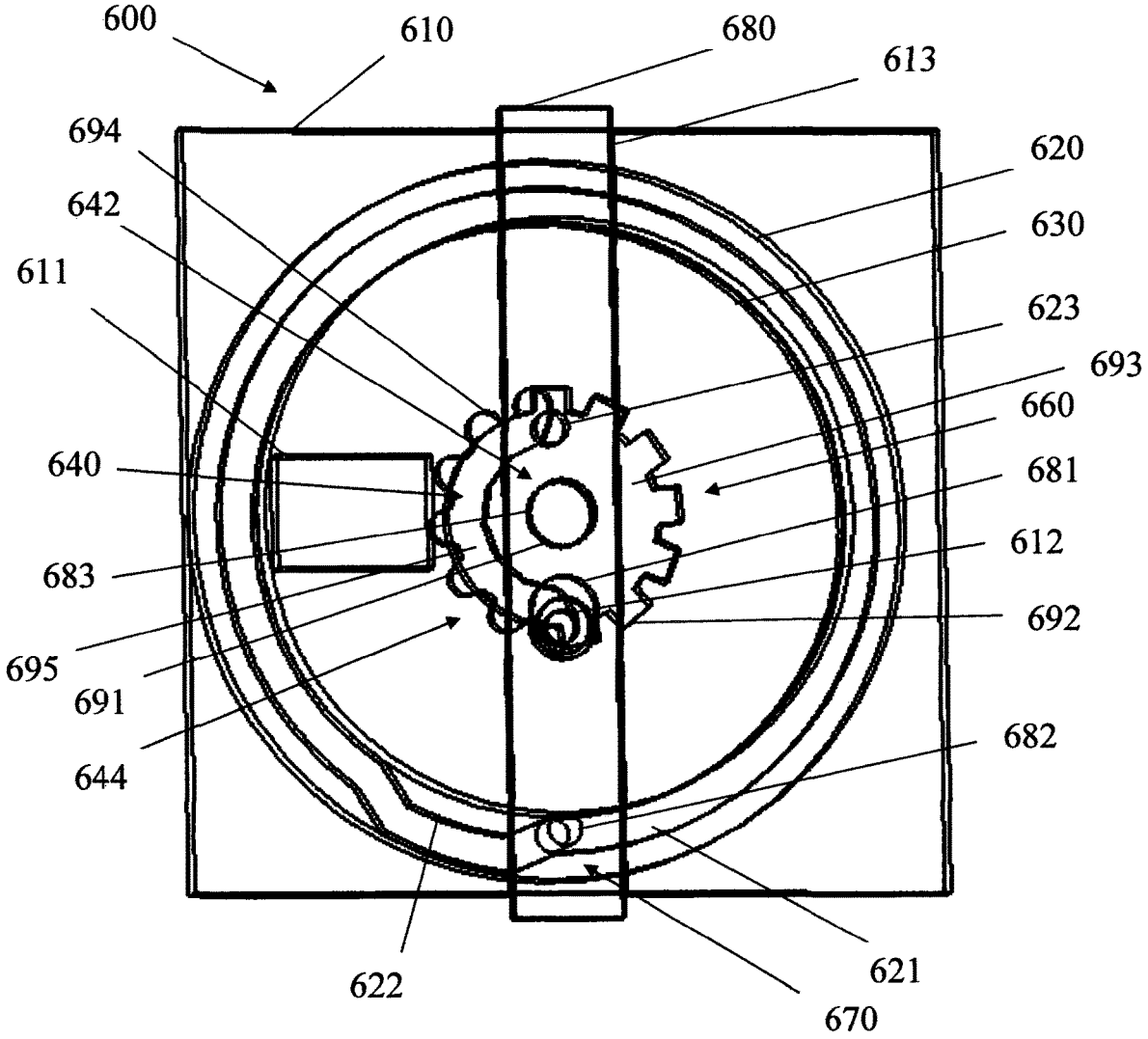
FIG. 6A shows a schematic plan view of a sixth embodiment of the counting device according to the invention.
Figure 6B:
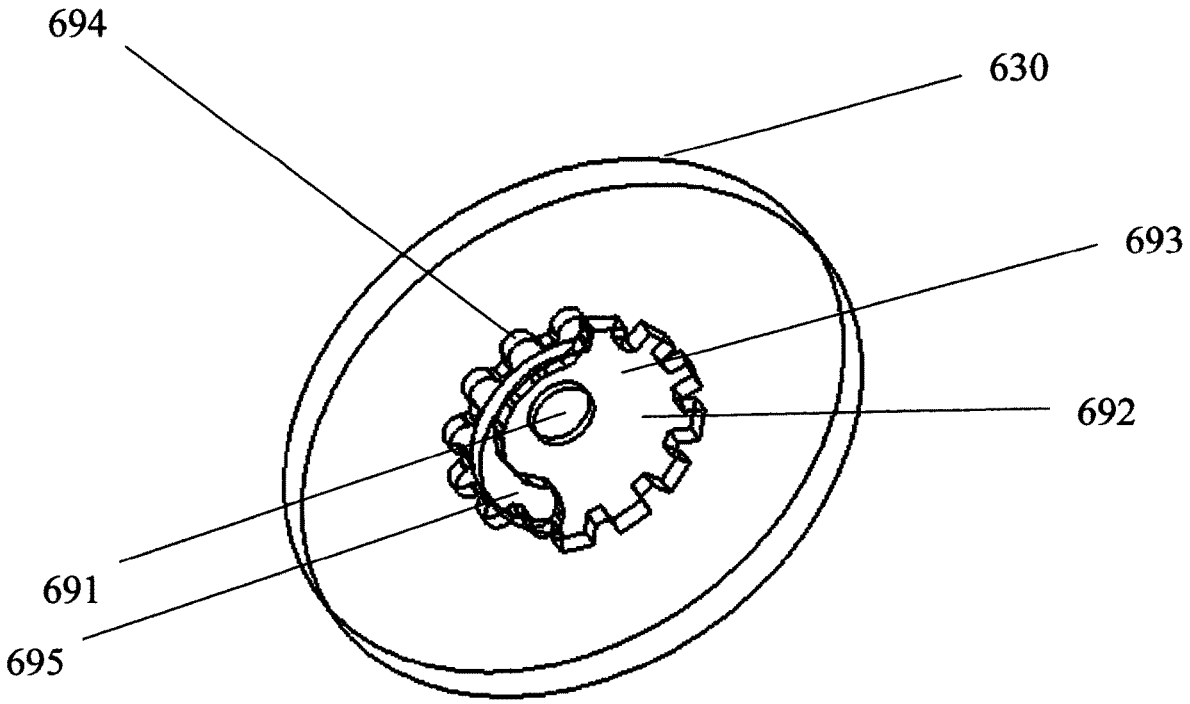
FIG. 6B shows a partial perspective view of the second counting wheel of the sixth embodiment of the counting device according to the invention.
Figure 6C:
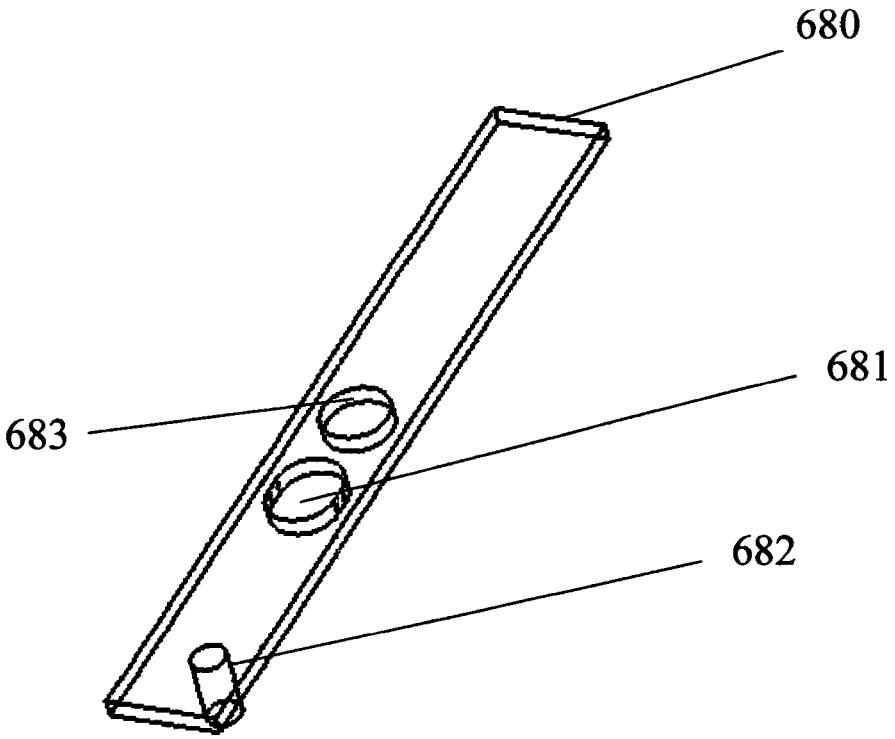
FIG. 6C shows a perspective view of the moving bearing plate of the sixth embodiment of the counting device according to the invention.
Figure 6D:
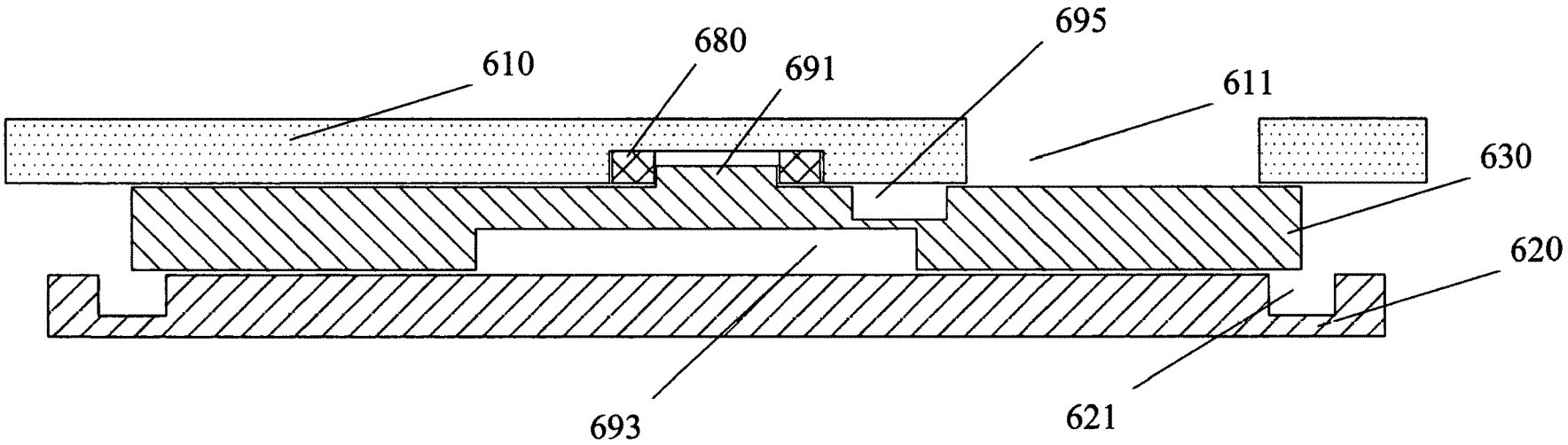
FIG. 6D shows a schematic cross-sectional view of the sixth embodiment of the counting device according to the invention.

It is to be understood that the various features that are described in the following and/or illustrated in the drawings are preferred but not essential. Combinations of features described and/or illustrated are not considered to be the only possible combinations. Unless stated to the contrary, individual features may be omitted, varied or combined in different combinations, where practical.

FIGS. 1A, 1B, 1C and 1D show a counting device 100 according to a first embodiment of the invention having a housing 110, a first counting wheel 120, a second counting wheel 130, a locking mechanism 140, a release mechanism 170 and a second counting wheel rotation mechanism 160. Housing 110 has a disk shape. On the upper surface of housing 110, a housing window 111 is formed. Housing 110 has a housing peg 112 and a housing slot 113.

First counting wheel 120 has a first counting wheel indexing peg 123 on its surface. On the circumference of first counting wheel 120 there is first counting wheel lip 129 which supports transparent first counting wheel indicia ring 124, on which numerals are marked clockwise from 0 to 9. The first counting wheel indicia ring 124 is transparent because it overlays the second counting wheel 130. The first counting wheel lip 129 has a height sufficient for a volume to be formed between first counting wheel indicia ring 124 and first counting wheel 120 which is big enough to accommodate the second counting wheel 130. The approximate height of each numeral is about 3.5 mm. Formed in the surface of the first counting wheel 120 there is a substantially circular first counting wheel cam track 121. The first counting wheel cam track 121 forms a first counting wheel cam 122.

Second counting wheel 130 has a second counting wheel disk 136 and second counting wheel gear 133. The second counting wheel disk 136 forms seven equally spaced indentations 132 on its circumference. On second counting wheel transparent disk 136, second counting wheel numerals 131 are marked clockwise from 1 to 6 between indentations. The approximate height of each numeral 131 is about 3.5 mm. On the seventh space between indentations 132, no numeral is marked. The second counting wheel gear 133 has a second counting wheel gear peg 134 extending through it. The second counting wheel gear 133 has second counting wheel gear indentations 135. The second counting wheel peg 134 forms an axle on which the second counting wheel 130 rotates. In an alternative embodiment, the second counting wheel transparent disk 136 forms a different number of indentations 132, for example from 5 to 10 indentations. In an alternative embodiment, the indentations 132 formed by second counting wheel transparent disk 136 and corresponding second counting wheel gear indentations 135 formed by second counting wheel gear 133 may be inequally spaced such that they are distributed at different angular positions around the second counting wheel transparent disk 136 and second counting wheel gear 133, respectively. Variable spacing of the indentations 132 could be beneficial in certain circumstances for example to accommodate a different size (for example height or width) of a corresponding numeral 131. In an alternative embodiment, each indentation 132 may be a projecting formation such as a tooth.

In use, second counting wheel gear peg 134 slots into housing slot 113 on one side of the second counting wheel 130 and slots into first counting wheel cam track 121 on the other side of the second counting wheel 130 such that the second counting wheel transparent disk 136 overlaps the first counting wheel 120. As the second counting wheel disk 136 is transparent, the numerals 124 of the first counting wheel 120 arranged beneath the second counting wheel 130 are visible through housing window 111. In a first configuration of the second counting wheel 130 at an inner end of housing slot 113, the orientation of the second counting wheel 130 is locked by locking mechanism 140. In a second configuration of the second counting wheel 130 at the outer end of housing slot 113, the orientation of the second counting wheel 130 may be changed by rotation mechanism 160. The second counting wheel 130 is moved from its first configuration to its second configuration by release mechanism 170 which comprises the first counting wheel cam 122 and second counting wheel gear peg 134.

The locking mechanism 140 comprises a location mechanism 142 and a rotating locking mechanism 144. The location mechanism 142 restricts movement of the second counting wheel 130 relative to the housing 110 to movement along housing slot 113. The location mechanism 142 is formed by the second counting wheel gear peg 134 engaging the housing slot 113. The rotating locking mechanism 144 prevents the second counting wheel 130 from rotating. The rotating locking mechanism 144 is formed by a second counting wheel indentation 132 engaging housing peg 112. The rotating locking mechanism 144 is released by release mechanism 170. The rotation mechanism 160 is formed by a second counting wheel gear indentation 135 engaging first counting wheel indexing peg 123 such that rotation of first counting wheel 120 causes simultaneous rotation of second counting wheel 130. After rotation of second counting wheel 130 through one indentation such that a different second counting wheel numeral 131 is visible through housing window 111, first counting wheel cam 122 releases second counting wheel gear peg 134 such that second counting wheel 130 moves back to its first configuration where housing peg 112 engages the next second counting wheel indentation 132 such that the second counting wheel 130 is locked in configuration by rotating locking mechanism 144.

The counting device 100 according to a first embodiment of the invention is configured to count downwards from a number of counts which is at most 69 such that the counting device 100 can be used as a remaining dose counting device in a medicament dispenser, for example. If the numerals are marked anti-clockwise on the first counting wheel 120 and second counting wheel 130, the counting device 100 could be used to count upwards to a maximum of 69. It will be understood by a person of skill in the art that the number from or to which the counting device 100 counts down or up, respectively, may be varied by changing the number of indentations 132 formed by second counting wheel transparent disk 136 and corresponding second counting wheel gear indentations 135 formed by second counting wheel gear 133.

FIGS. 2A, 2B, 2C and 2D show a counting device 200 according to a second embodiment of the invention having a housing 210, a first counting wheel 220, a second counting wheel 230, a locking mechanism 240, a release mechanism 270 and a second counting wheel rotation mechanism 260. Housing 210 has a disk shape. On the upper surface of housing 210, a housing window 211 is formed. Housing 210 has a housing peg 212 and a housing slot 213.

First counting wheel 220 has a first counting wheel indexing peg 223 on its surface at the circumference of first counting wheel 220. On the circumference of first counting wheel 220 there is first counting wheel lip 229 which supports transparent first counting wheel indicia ring 224 on which numerals are marked clockwise from 0 to 9. The first counting wheel indicia ring 224 is transparent because it overlays the second counting wheel 230. The first counting wheel lip 229 has a height sufficient for a volume to be formed between first counting wheel indicia ring 224 and first counting wheel 220 sufficient to accommodate the second counting wheel 230. The approximate height of each numeral 224 is about 3.5 mm. Formed in the surface of the first counting wheel 220 there is a substantially circular first counting wheel cam track 221. The first counting wheel cam track 221 forms a first counting wheel cam 222.

Second counting wheel 230 has an inner disk 236 which bears an outer second counting wheel gear 233. The second counting wheel gear 233 is toothed in that it forms seven equally spaced second counting wheel gear indentations 235 on its circumference. On the inner disk 236 of second counting wheel 230, second counting wheel numerals 231 are marked clockwise from 1 to 6 between indentations 235. The approximate height of each numeral 231 is about 3.5 mm. On the seventh space between indentations 235, no numeral is marked. The second counting wheel 230 has a second counting wheel gear peg 234 extending through it. The second counting wheel gear peg 234 forms an axle on which the second counting wheel 230 rotates. In an alternative embodiment, the second counting wheel gear 233 forms a different number of indentations 235, for example from 5 to 10 indentations. In an alternative embodiment, the indentations 235 formed by second counting wheel gear 233 may be inequally spaced such that they are distributed at different angular positions around second counting wheel gear 233. Variable spacing of the indentations 235 could be beneficial in certain circumstances for example to accommodate a different size (for example height or width) of a corresponding numeral 231. In an alternative embodiment, each indentation 235 may be a projecting formation such as a tooth. In an alternative embodiment, the space between indentations 235 where no numeral 231 is marked may be coloured. A coloured tint on the space with no numeral is useful where the counting device 200 is used to count remaining items in a dispenser as it highlights the proximity of the count to zero.

In use, second counting wheel gear peg 234 slots into housing slot 213 on one side of the second counting wheel 230 and slots into first counting wheel cam track 221 on the other side of the second counting wheel 230 such that the second counting wheel transparent disk 236 overlaps the first counting wheel 220. As the second counting wheel disk 236 is transparent, the numerals 224 of the first counting wheel 220 arranged beneath the second counting wheel 230 are visible through housing window 211. In a first configuration of the second counting wheel 230 at an inner end of housing slot 213, the orientation of the second counting wheel 230 is locked by locking mechanism 240. In a second configuration of the second counting wheel 230 at the outer end of housing slot 213, the orientation of the second counting wheel 230 may be changed by rotation mechanism 260. The second counting wheel 230 is moved from its first configuration to its second configuration by release mechanism 270 which comprises the first counting wheel cam 222 and second counting wheel peg 234.

The locking mechanism 240 comprises a location mechanism 242 and a rotating locking mechanism 244. The location mechanism 242 restricts movement of the second counting wheel 230 relative to the housing 210 to movement along housing slot 213. The location mechanism 242 is formed by the second counting wheel gear peg 234 engaging the housing slot 213. The rotating locking mechanism 244 prevents the second counting wheel 230 from rotating. The rotating locking mechanism 244 is formed by a second counting wheel gear indentation 235 engaging housing peg 212. The rotating locking mechanism 244 is released by release mechanism 270. The rotation mechanism 260 is formed by a second counting wheel indentation 235 engaging first counting wheel indexing peg 223 such that rotation of first counting wheel 220 causes simultaneous rotation of second counting wheel 230. After rotation of second counting wheel 230 through one indentation such that a different second counting wheel numeral 231 is visible through housing window 211, first counting wheel cam 222 releases second counting wheel peg 234 such that second counting wheel 230 moves back to its first configuration where housing peg 212 engages the next second counting wheel indentation 235 such that the second counting wheel 230 is locked in configuration by rotating locking mechanism 244.

The counting device 200 according to a second embodiment of the invention is configured to count downwards from a number of counts which is at most 69 such that the counting device 200 can be used as a remaining dose counting device in a medicament dispenser, for example. If the numerals are marked anti-clockwise on the first counting wheel 220 and second counting wheel 230, the counting device 200 could be used to count upwards to a maximum of 69. It will be understood by a person of skill in the art that the number from or to which the counting device 200 counts down or up, respectively, may be varied by changing the number of indentations 232 formed by second counting wheel transparent disk 236 and corresponding second counting wheel gear indentations 235 formed by second counting wheel gear 233.

FIGS. 3A, 3B, 3C, 3D and 3E show a compact counting device 300 according to a third embodiment of the invention having a housing 310, a first counting wheel 320, a second counting wheel 330, a locking mechanism 340, a release mechanism 370 and a second counting wheel rotation mechanism 360. Housing 310 has an oval shape which is formed from a housing back 315 and a housing cover 314. On the surface of housing cover 314, a housing window 311 is formed. Housing back 315 has a housing peg 312. On an inner surface of housing cover 314, a housing slot 313 is provided.

First counting wheel 320 has a first counting wheel indexing peg 323 on its surface at the circumference of first counting wheel 320. The circumference of first counting wheel 320 forms a lip 329 which supports first counting wheel indicia ring 324, on which indicia in the form of numerals are marked clockwise from 0 to 9. The first counting wheel indicia ring 324 is thin, having a thickness of about 150 μm and is arranged at the periphery of the first counting wheel 320. The first counting wheel lip 329 has a height sufficient for a volume to be formed between first counting wheel indicia ring 324 and first counting wheel 320 which is sufficient to accommodate the second counting wheel 230. The approximate height of each numeral on indicia ring 324 is about 3.5 mm. Formed in the surface of the first counting wheel 320 there is a substantially circular first counting wheel cam track 321. The first counting wheel cam track 321 forms a first counting wheel cam 322.

Second counting wheel 330 has an inner second counting wheel gear 333 which bears a transparent second counting wheel indicia ring 336. The second counting wheel indicia ring 336 is transparent because it overlays the first counting wheel indicia ring 324. The second counting wheel indicia ring 336 is thin, having a thickness of about 150 μm and is arranged at the periphery of the second counting wheel 330. The inner second counting wheel gear 333 is placed on top of the first counting wheel 330 but below the first counting wheel indicia ring 324. The second counting wheel gear 333 is toothed in that it forms seven equally spaced second counting wheel gear indentations 335 on its circumference. On the second counting wheel indicia ring 336 of second counting wheel 330, second counting wheel indicia 331 are marked in the form of numerals clockwise from 1 to 6 between indentations 335. The approximate height of each numeral 331 is about 3.5 mm. On the seventh space between indentations 335, no numeral is marked. The second counting wheel 330 has a second counting wheel gear peg 334 extending through it. The second counting wheel gear peg 334 forms an axle on which the second counting wheel 330 rotates. In an alternative embodiment, the second counting wheel gear 333 forms a different number of indentations 335, for example from 5 to 10 indentations. In an alternative embodiment, the indentations 335 formed by second counting wheel gear 333 may be inequally spaced such that they are distributed at different angular positions around second counting wheel gear 333. Variable spacing of the indentations 335 could be beneficial in certain circumstances for example to accommodate a different size (for example height or width) of a corresponding numeral 331. In an alternative embodiment, each indentation 335 may be a projecting formation such as a tooth. In an alternative embodiment, the space between indentations 335 where no numeral is marked may be coloured. A coloured tint on the space with no numeral is useful where the counting device 300 is used to count remaining items in a dispenser as it highlights the proximity of the count to zero.

In use, second counting wheel gear peg 334 slots into housing slot 313 on the inner side of the housing cover 314 and slots into first counting wheel cam track 321 on the other side of the second counting wheel 330 such that the second counting wheel transparent disk 336 overlaps the first counting wheel 320. As the second counting wheel disk 336 is transparent, the numerals 324 of the first counting wheel 320 arranged beneath the second counting wheel 330 are visible through housing window 311. In a first configuration of the second counting wheel 330 at an inner end of housing slot 313, the orientation of the second counting wheel 330 is locked by locking mechanism 340. In a second configuration of the second counting wheel 330 at the outer end of housing slot 313, the orientation of the second counting wheel 330 may be changed by rotation mechanism 360. The second counting wheel 330 is moved from its first configuration to its second configuration by release mechanism 270 which comprises the first counting wheel cam 322 and second counting wheel gear peg 334.

The locking mechanism 340 comprises a location mechanism 342 and a rotating locking mechanism 344. The location mechanism 342 restricts movement of the second counting wheel 330 relative to the housing 310 to movement along housing slot 313. The location mechanism 342 is formed by the second counting wheel gear peg 334 engaging the housing slot 313. The rotating locking mechanism 344 prevents the second counting wheel 330 from rotating. The rotating locking mechanism 344 is formed by a second counting wheel gear indentation 335 engaging first counting wheel hub 327. The rotating locking mechanism 144 is released by release mechanism 170. The rotation mechanism 360 is formed by a second counting wheel gear indentation 335 engaging first counting wheel indexing peg 123 such that rotation of first counting wheel 320 causes simultaneous rotation of second counting wheel 330. After rotation of second counting wheel 330 through one indentation 335 such that a different second counting wheel numeral 331 is visible through housing window 311, first counting wheel cam 322 releases second counting wheel peg 334 such that second counting wheel 330 moves back to its first configuration where first counting wheel hub 327 engages the next second counting wheel gear indentation 335 such that the second counting wheel 330 is locked in configuration by rotating locking mechanism 344.

The counting device 300 according to a third embodiment of the invention is configured to count downwards from a number of counts which is at most 69 such that the counting device 300 can be used as a remaining dose counting device in a medicament dispenser, for example. If the numerals are marked anti-clockwise on the first counting wheel 320 and second counting wheel 330, the counting device 300 could be used to count upwards to a maximum of 69. It will be understood by a person of skill in the art that the number from or to which the counting device 300 counts down or up, respectively, may be varied by changing the number of indentations 332 formed by second counting wheel transparent disk 336 and corresponding second counting wheel gear indentations 335 formed by second counting wheel gear 333.

FIGS. 4A, 4B, 4C, 4D and 4E show a counting device 400 according to a fourth embodiment of the invention having a housing 410, a first counting wheel 420, a second counting wheel 430, a locking mechanism 440, a sliding lock 450, a release mechanism 470 and a second counting wheel rotation mechanism 460. Housing 410 has a rectangular shape which is formed from a housing back (not shown) and a housing cover 414. On the surface of the housing cover 414, a housing window 411 is formed. On an inner surface of housing cover 414, a housing peg 412 and parallel housing guides 416 are provided.

First counting wheel 420 forms a circumferential inner rail 425 and a circumferential outer rail 428. A first counting wheel indexing peg 123 is formed on the circumferential outer rail 428. On the surface of first counting wheel 420 first counting wheel numerals 424 are marked clockwise from 0 to 9. The approximate height of each numeral 424 is about 3.5 mm. The first counting wheel rail 425 forms a first counting wheel rail gap 426. The first counting wheel indexing peg 123 is positioned in the gap between numerals 9 and 0 and the first counting wheel rail gap 426 is opposite the first counting wheel indexing peg 123 such that it is in the gap between numerals 4 and 5.

Second counting wheel 430 has a transparent disk 436 which bears an inner second counting wheel gear 433 having a second counting wheel gear hub 438. The second counting wheel gear 433 has seven second counting wheel gear teeth 439 which form seven equally spaced second counting wheel gear indentations 435. On the transparent disk 436 of second counting wheel 430, second counting wheel numerals 431 are marked clockwise from 1 to 6 between indentations 435. The approximate height of each numeral 431 is about 3.5 mm. On the seventh space between indentations 435, no numeral is marked.

Sliding lock 450 has a lock body 452 forming a lock cam 451 and a lock peg 453.

In use, second counting wheel gear hub 438 is mounted on housing peg 412 on the inner side of the housing cover 414 such that the second counting wheel 430 overlaps the first counting wheel 420. As the second counting wheel disk 436 is transparent, the numerals 424 of the first counting wheel 420 arranged beneath the second counting wheel 430 are visible through housing window 411.

In a first configuration of the first and second counting wheels 420,430, the second counting wheel 430 is locked by locking mechanism 440 such that it cannot rotate. The locking mechanism 440 comprises a location mechanism 442 and a rotating locking mechanism 444. The location mechanism 442 locks the location of the second counting wheel 430 relative to the housing 410. The location mechanism 442 is formed by the second counting wheel gear hub 438 engaging the housing peg 412. The rotating locking mechanism 444 prevents the second counting wheel 430 from rotating. The rotating locking mechanism 444 is formed by second counting wheel gear teeth 439 bearing against first counting wheel outer rail 428 and second counting wheel gear indentation 435 bearing against lock cam 451. Lock peg 453 bears against first counting wheel inner rail 425 such that the sliding lock 450 and so the second counting wheel 430 are in a locked configuration.

In a second configuration of the first and second counting wheels 420,430, the second counting wheel 430 is unlocked such it be rotated by the rotation mechanism 460. The rotating locking mechanism 444 is released by release mechanism 470. Release mechanism 470 comprises lock peg 453 and first counting wheel inner rail gap 426. The rotation mechanism 460 is formed by second counting wheel gear indentation 435 engaging first counting wheel indexing peg 423. The operation of the rotation mechanism 460 pushes second counting wheel gear 433 such that a second counting wheel gear tooth 439 bears against lock cam 451. This forces lock body 452 between housing guides 416 such that lock peg 453 moves into first counting wheel inner rail gap 426 and the rotating locking mechanism 444 is unlocked by release mechanism 470. The second counting wheel 430 is free to rotate by one second counting wheel gear indentation 435 such that a different second counting wheel numeral 431 is shown through housing window 411. After rotation of the second counting wheel 430 driven by first counting, wheel indexing peg 423 on first counting wheel outer rail 428, the positions of the first and second counting wheels 420,430 return to the first configuration and the rotating locking mechanism 444 re-engages.

The counting device 400 according to a fourth embodiment of the invention is configured to count downwards from a number of counts which is at most 69 such that the counting device 400 can be used as a remaining dose counting device in a medicament dispenser, for example. If the numerals are marked anti-clockwise on the first counting wheel 420 and second counting wheel 430, the counting device 400 could be used to count upwards to a maximum of 69. It will be understood by a person of skill in the art that the number from or to which the counting device 400 counts down or up, respectively, may be varied by changing the number of indentations 432 formed by second counting wheel transparent disk 436 and corresponding second counting wheel gear indentations 435 formed by second counting wheel gear 433.

FIGS. 5A, 5B, 5C, 5D, 5E and 5F show a counting device 500 according to a fifth embodiment of the invention having a housing 510, a first counting wheel 520, a second counting wheel 530, a locking mechanism 540, a release mechanism 570 and a second counting wheel rotation mechanism 560. Housing 510 has a rectangular shape which is formed from a housing back (not shown) and a housing cover 514. On the surface of the housing cover 514, a housing window 511 is formed. On an inner surface of housing cover 514, a housing peg 512 is provided.

First counting wheel 520 forms a circumferential inner rail 525 and a circumferential outer rail 528. A first counting wheel indexing peg 523 is formed on the circumferential outer rail 528. On the surface of first counting wheel 520 first counting wheel numerals 524 are marked clockwise from 0 to 9. The approximate height of each numeral 524 is about 3.5 mm. The first counting wheel rail 525 forms first counting wheel rail gaps 526 which are aligned at the anti-clockwise end of numerals 9 and 1. The first counting wheel indexing peg 523 is positioned in the gap between numerals 9 and 0.

Second counting wheel 530 has a transparent disk 536 which bears an inner second counting wheel gear 533 having a second counting wheel gear hub 538. The second counting wheel gear 533 has seven second counting wheel gear teeth 539 which form seven equally spaced second counting wheel gear indentations 535. On each second counting wheel gear tooth 539, a second counting wheel gear tooth peg 537 projects downwards. On the transparent disk 536 of second counting wheel 530, second counting wheel numerals 531 are marked clockwise from 1 to 6 between indentations 535. The approximate height of each numeral 531 is about 3.5 mm. On the seventh space between numerals 6 and 1, no numeral is marked.

In use, second counting wheel gear hub 538 is mounted on housing peg 512 on the inner side of the housing cover 514 such that the second counting wheel 530 overlaps the first counting wheel 520. As the second counting wheel disk 536 is transparent, the numerals 524 of the first counting wheel 520 arranged beneath the second counting wheel 530 are visible through housing window 511.

In a first configuration of the first and second counting wheels 520,530, the second counting wheel 530 is locked by locking mechanism 540 such that it cannot rotate. The locking mechanism 540 comprises a location mechanism 542 and a rotating locking mechanism 544. The location mechanism 542 locks the location of the second counting wheel 530 relative to the housing 510. The location mechanism 542 is formed by the second counting wheel gear hub 538 engaging the housing peg 512. The rotating locking mechanism 544 prevents the second counting wheel 530 from rotating. The rotating locking mechanism 544 is formed by second counting wheel gear teeth pegs 537 bearing against first counting wheel inner rail 525 and first counting wheel outer rail 528.

In a second configuration of the first and second counting wheels 520,530, the second counting wheel 530 is unlocked by the release mechanism 570 such that the second counting wheel 530 can be rotated by the rotation mechanism 560. The rotation mechanism 560 comprises second counting wheel gear tooth peg 537 and first counting wheel indexing peg 523. The release mechanism 570 comprises second counting wheel gear teeth pegs 537 and first counting wheel inner rail gaps 526. The rotation mechanism 560 is activated by second counting wheel gear tooth peg 537 contacting first counting wheel indexing peg 523. The second counting wheel 530 is free to rotate because of the activation of release mechanism 570 by second counting wheel gear teeth pegs 537 moving through first counting wheel inner rail gaps 526. The second counting wheel 530 is free to rotate by one second counting wheel gear indentation 535 such that a different second counting wheel numeral 531 is shown through housing window 511. After rotation of the second counting wheel 530, the positions of the first and second counting wheels 520,530 return to the first configuration.

The counting device 500 according to a fifth embodiment of the invention is configured to count downwards from a number of counts which is at most 69 such that the counting device 500 can be used as a remaining dose counting device in a medicament dispenser, for example. If the numerals are marked anti-clockwise on the first counting wheel 520 and second counting wheel 530, the counting device 500 could be used to count upwards to a maximum of 69. It will be understood by a person of skill in the art that the number from or to which the counting device 500 counts down or up, respectively, may be varied by changing the number of indentations 532 formed by second counting wheel transparent disk 536 and corresponding second counting wheel gear indentations 535 formed by second counting wheel gear 533.

FIGS. 6A, 6B, 6C and 6D show a counting device 600 according to a sixth embodiment of the invention having a housing 610, a first counting wheel 620, a second counting wheel 630, a locking mechanism 640, a release mechanism 670 and a second counting wheel rotation mechanism 660. Housing 610 has a square shape and comprises a moving bearing plate 680. On the upper surface of housing 610, a housing window 611 is formed. Housing 610 has a housing peg 612 and a housing slot 613 for receiving the moving bearing plate 680. Moving bearing plate 680 has a moving bearing plate slot 681 through which housing peg 612 extends, a moving bearing plate peg 682 and a moving bearing plate hole 683.

First counting wheel 620 has a first counting wheel indexing peg 123 on its surface. First counting wheel 620 is marked with indicia (not shown) in the form of numerals which may be marked clockwise from 0 to 9. Formed in the surface of the first counting wheel 620 there is a substantially circular first counting wheel cam track 621. The first counting wheel cam track 621 forms a first counting wheel cam 622.

Second counting wheel 630 is transparent in at least an annular surface which covers the indicia of the first counting wheel 620 such that the indicia of the first counting wheel 620 are visible. Second counting wheel 630 has an upper and a lower surface. Second counting wheel 630 has a second counting wheel peg 691 at the centre of its upper surface. The lower surface of second counting wheel 630 rests on the first counting wheel. Formed in the lower surface of the second counting wheel 630 are second counting wheel rotation track 693 and seven second counting wheel rotation indentations 692. Formed in the upper surface of the second counting wheel 630 are second counting wheel rotation lock track 695 and seven second counting wheel rotation lock indentations 694. On the lower surface of second counting wheel 630, second counting wheel indicia (not shown) are marked clockwise from 1 to 6 and a space is provided on which no numeral is marked. In an alternative embodiment, the space on which no numeral is marked may be coloured. A coloured tint on the space with no numeral is useful where the counting device 600 is used to count remaining items in a dispenser as it highlights the proximity of the count to zero.

In use, second counting wheel peg 691 slots into moving bearing plate hole 683. Housing peg 612 extends through moving bearing plate slot 681 into second counting wheel rotation lock track 695 on the upper surface of second counting wheel 630. First counting wheel indexing peg 123 is inserted into second counting wheel rotation track 693 on the lower surface of second counting wheel 630. Moving bearing plate peg 682 is inserted into first counting wheel cam track 621. As the second counting wheel 630 is transparent, the numerals (not shown) of the first counting wheel 620 arranged beneath the second counting wheel 630 are visible through housing window 611. In a first configuration of the second counting wheel 630 at an outer end of moving bearing plate slot 681, the orientation of the second counting wheel 630 is locked by locking mechanism 640. In a second configuration of the second counting wheel 630 at the inner end of moving bearing plate slot 681, the orientation of the second counting wheel 630 may be changed by rotation mechanism 660. The second counting wheel 630 is moved from its first configuration to its second configuration by release mechanism 670 which comprises the first counting wheel cam 622 and moving bearing plate peg 682.

The locking mechanism 640 comprises a location mechanism 642 and a rotating locking mechanism 644. The location mechanism 642 restricts movement of the second counting wheel 630 relative to the housing 610 to movement along moving bearing plate slot 681. The location mechanism 642 is formed by the second counting wheel peg 691 engaging the moving bearing plate hole 683. The rotating locking mechanism 644 prevents the second counting wheel 630 from rotating. The rotating locking mechanism 644 is formed by a second counting wheel rotation lock indentation 694 engaging housing peg 612. The rotating locking mechanism 644 is released by release mechanism 670. The rotation mechanism 660 is formed by a second counting wheel rotation indentation 692 engaging first counting wheel indexing peg 123 such that rotation of first counting wheel 620 causes simultaneous rotation of second counting wheel 630. After rotation of second counting wheel 630 through one indentation such that a different second counting wheel numeral is visible through housing window 611, first counting wheel cam 622 releases moving bearing plate peg 682 such that second counting wheel 630 moves back to its first configuration where housing peg 612 engages the next second counting wheel rotation lock indentation 694 such that the second counting wheel 630 is locked in configuration by rotating locking mechanism 644.

The counting device 600 according to a sixth embodiment of the invention is configured to count downwards from a number of counts which is at most 69 such that the counting device 600 can be used as a remaining dose counting device in a medicament dispenser, for example. If the numerals are marked anti-clockwise on the first counting wheel 620 and second counting wheel 630, the counting device 600 could be used to count upwards to a maximum of 69. It will be understood by a person of skill in the art that the number from or to which the counting device 600 counts down or up, respectively, may be varied by changing the number of second counting wheel rotation indentations 692 and second counting wheel rotation lock indentations 694.

FIGS. 7A, 7B, 7C, 7D show a counting device 700A according to a seventh embodiment of the invention having a housing (not shown), a first counting wheel 720, a second counting wheel 730A, a locking mechanism 740, a release mechanism 770 and a second counting wheel rotation mechanism 760. Housing (not shown) has a housing window 711.

First counting wheel 720 forms a first counting wheel circumferential rail 725 and a first counting wheel hub 796. A first counting wheel indexing peg 723 is formed between the first counting wheel hub 796 and the first counting wheel circumferential rail 725 with sufficient space between the first counting wheel indexing peg 723 and the first counting wheel circumferential rail 725 for a second counting wheel peg 737A to pass. On an outer annular surface of first counting wheel 520 first counting wheel indicia 724 are marked clockwise in the form of numerals from 0 to 9. The approximate height of each numeral 724 is about 3.5 mm. The first counting wheel rail 725 forms first counting wheel rail gaps 726 which are aligned at the anti-clockwise end of numerals 9 and 0. The first counting wheel indexing peg 723 is positioned in the gap between numerals 9 and 0.

Second counting wheel 730A is a transparent disk which has a hub 797 and which bears eight second counting wheel pegs 737A arranged in a circle on its lower surface. On the lower surface of second counting wheel 730, second counting wheel indicia 731 are marked clockwise in the form of numerals from 1 to 6, each aligned with a second counting wheel peg 737A. The approximate height of each numeral 731 is about 3.5 mm. On the seventh and eighth spaces between numerals 6 and 1, no numeral is marked.

In use, second counting wheel gear hub 797 is mounted on a housing peg (not shown) such that the second counting wheel 730A overlaps the first counting wheel 720. As the second counting wheel disk 736 is transparent, the numerals 724 of the first counting wheel 720 arranged beneath the second counting wheel 730A are visible through housing window 711.

In a first configuration of the first and second counting wheels 720,730A, the second counting wheel 730A is locked by locking mechanism 740 such that it cannot rotate. The locking mechanism 740 comprises a location mechanism 742 and a rotating locking mechanism 744. The location mechanism 742 locks the location of the second counting wheel 730 relative to the housing (not shown). The location mechanism 742 is formed by the second counting wheel hub 797 engaging a housing peg (not shown). The rotating locking mechanism 744 prevents the second counting wheel 730 from rotating. The rotating locking mechanism 744 is formed by second counting wheel pegs 737A bearing against first counting wheel rail 725.

In a second configuration of the first and second counting wheels 720,730A, the second counting wheel 730A is unlocked by the release mechanism 770 such that the second counting wheel 730A can be rotated by the rotation mechanism 760. The rotation mechanism 760 comprises second counting wheel peg 737A and first counting wheel indexing peg 723. The release mechanism 770 comprises second counting wheel pegs 737A and first counting wheel rail gaps 726. The rotation mechanism 760 is activated by second counting wheel peg 737A contacting first counting wheel indexing peg 723. The second counting wheel 730A is free to rotate because of the activation of release mechanism 770 by second counting wheel pegs 737A moving through first counting wheel inner rail gaps 726. The second counting wheel 730 is free to rotate by one second counting wheel peg 737A such that a different second counting wheel numeral 731 is shown through housing window 711. After rotation of the second counting wheel 730A, the positions of the first and second counting wheels 720,730A return to the first configuration.

The counting device 700 according to a seventh embodiment of the invention is configured to count downwards from a number of counts which is at most 69 such that the counting device 700 can be used as a remaining dose counting device in a medicament dispenser, for example. If the numerals are marked anti-clockwise on the first counting wheel 720 and second counting wheel 730A, the counting device 700 could be used to count upwards to a maximum of 69. It will be understood by a person of skill in the art that the number from or to which the counting device 700 counts down or up, respectively, may be varied by changing the number of second counting wheel pegs 737A.

Figure 7A:
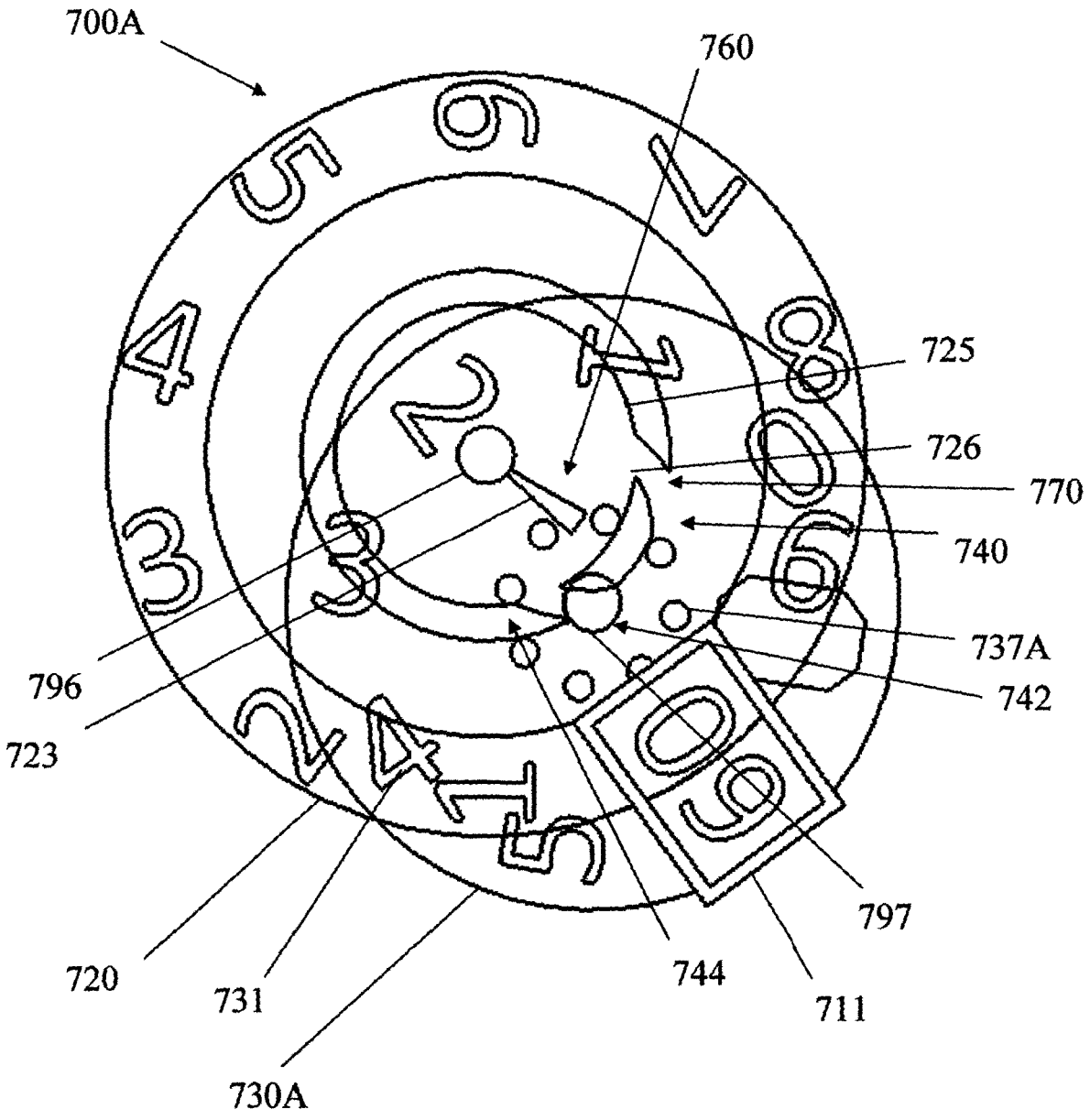
FIG. 7A shows a partial schematic plan view of the seventh embodiment of the counting device according to the invention.
Figure 7B:
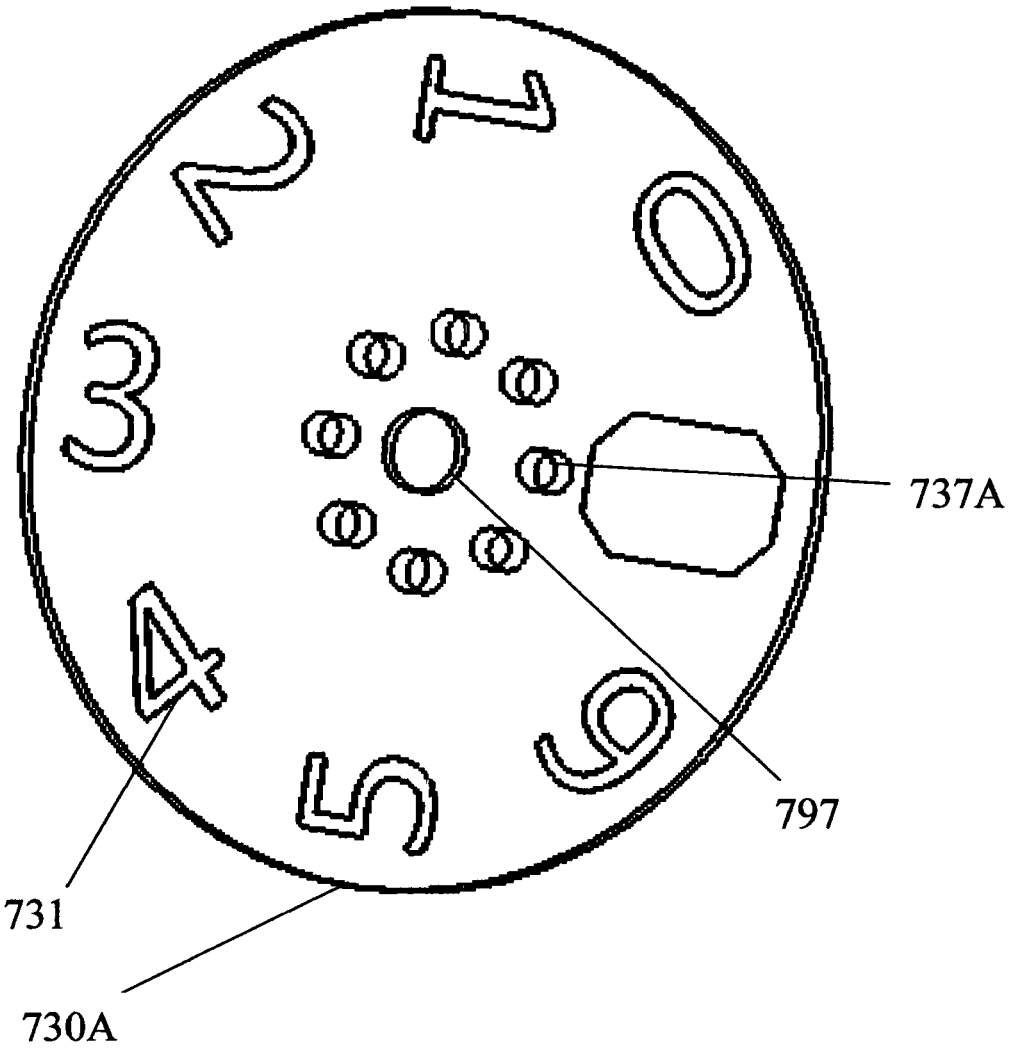
FIG. 7B shows a schematic perspective view of the second counting wheel of the seventh embodiment of the counting device according to the invention.
Figure 7C:
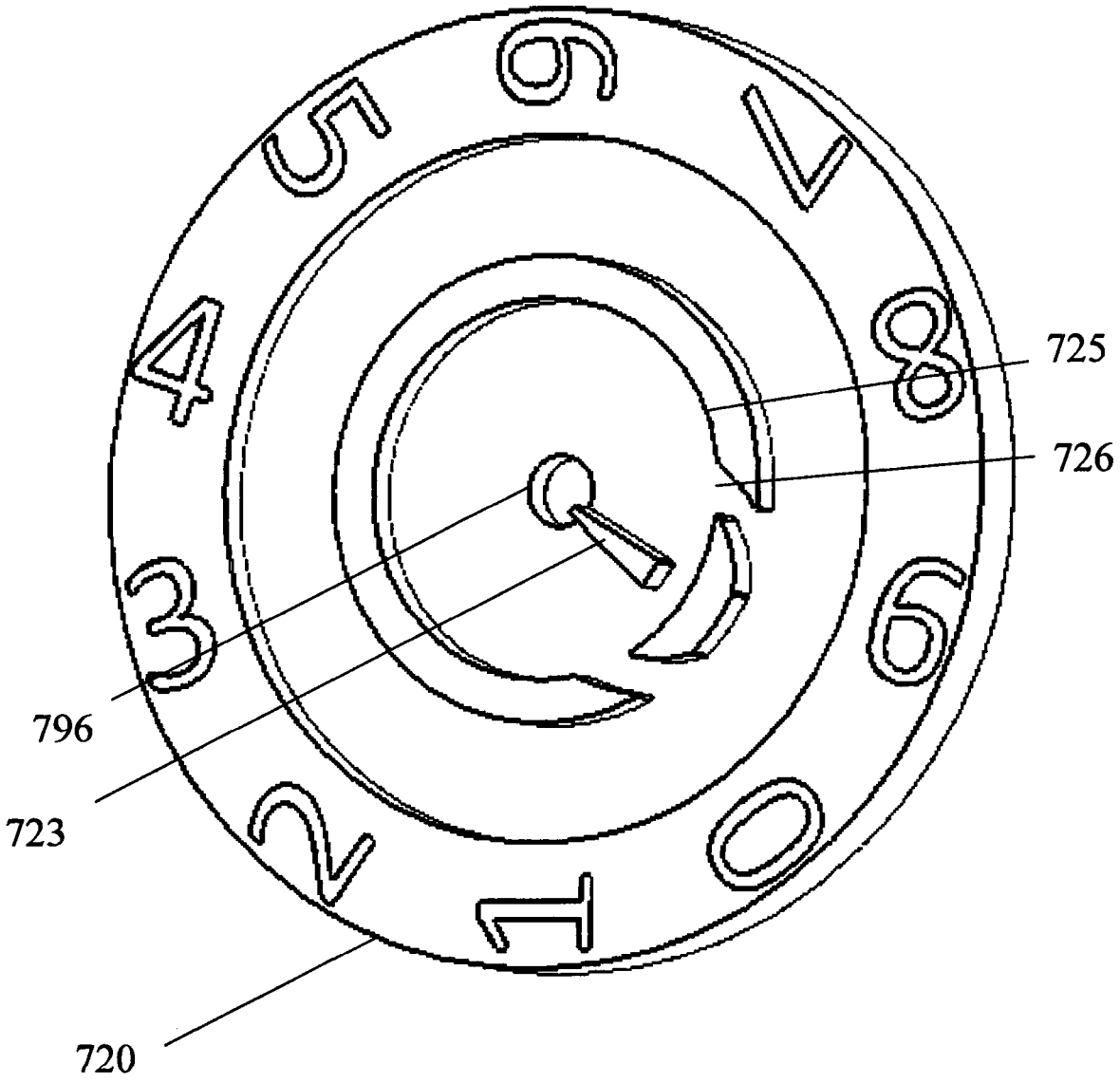
FIG. 7C shows a schematic perspective view of the first counting wheel of the seventh embodiment of the counting device according to the invention.
Figure 7D:
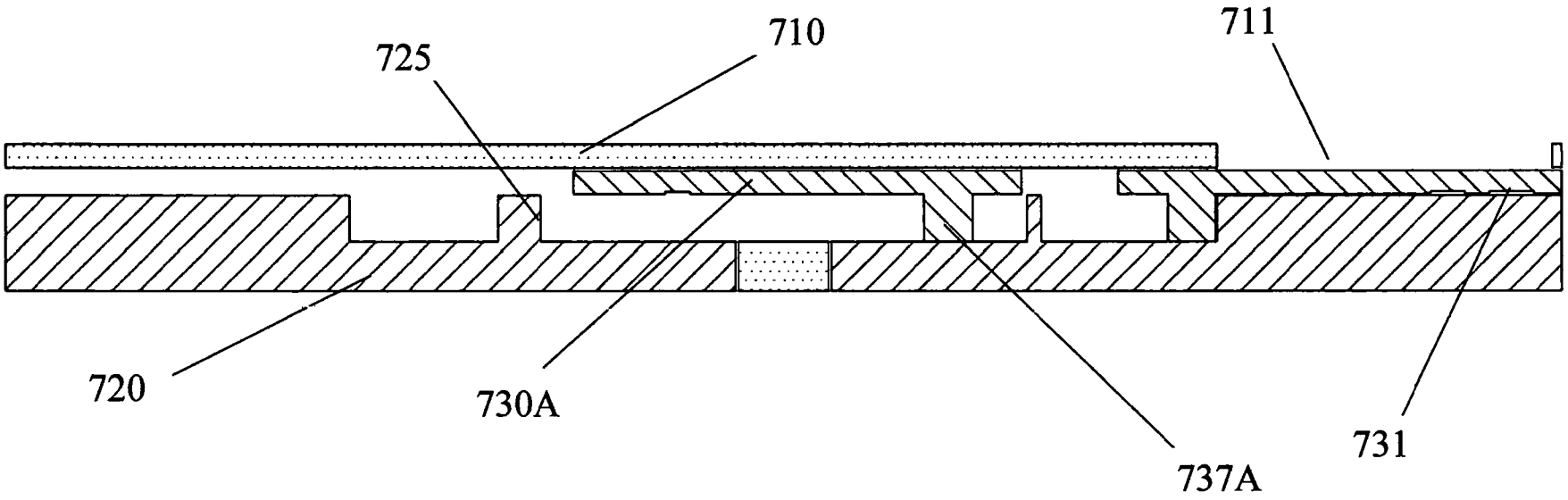
FIG. 7D shows a schematic cross-sectional view of the seventh embodiment of the counting device according to the invention.
Figure 7E:
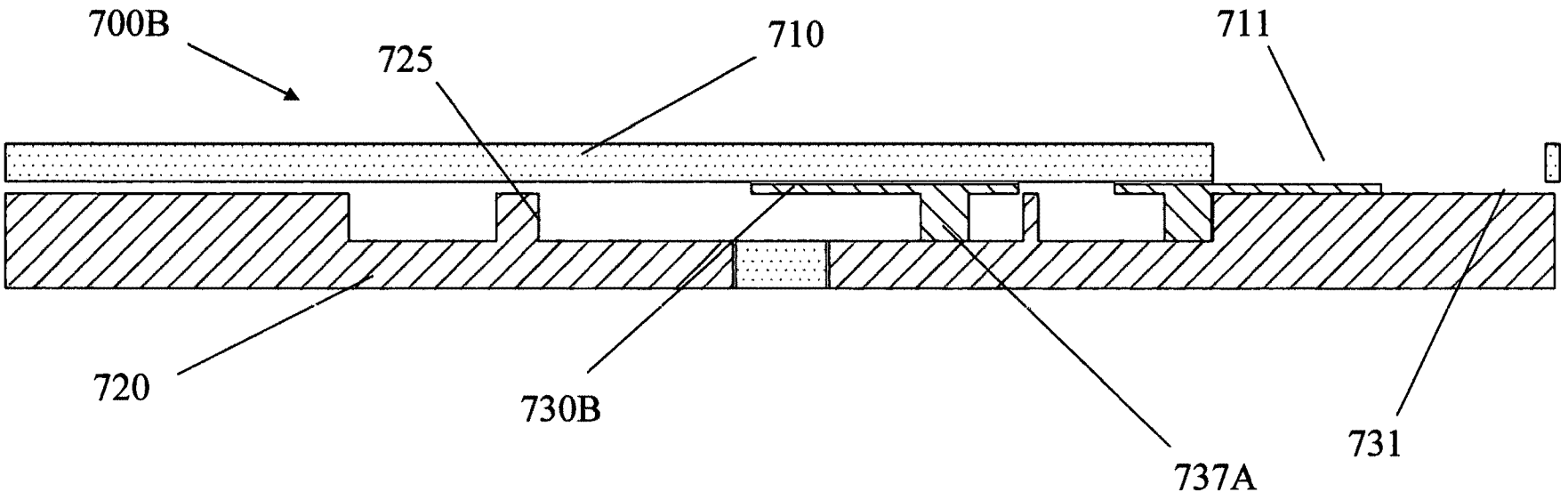
FIG. 7E shows a schematic cross-sectional view of the eighth embodiment of the counting device according to the invention.

FIG. 7E shows a counting device 700B according to an eighth embodiment of the invention. The counting device 700B is an alternative arrangement to counting device 700A. The mechanism of counting device 700B is the same as that of counting device 700A but the second counting wheel 730B is not transparent. Instead, the second counting wheel 730B only partially covers the first counting wheel 720. Thus, in the housing window 711, the first counting wheel indicia 724 can be viewed directly. In order to minimise the visual impact of the outer edge of the second counting wheel 730B and to minimise any separation between the planes on which the two sets of indicia 724,731 are displayed, the second counting wheel 730B is thin (having a thickness of 400 μm or less, for example 200 μm or less) at the edge. This arrangement provides a display that is almost as clear as using transparent effects, but without requiring transparent materials. This alternative arrangement can also be applied in other embodiments.

Figure 7F:
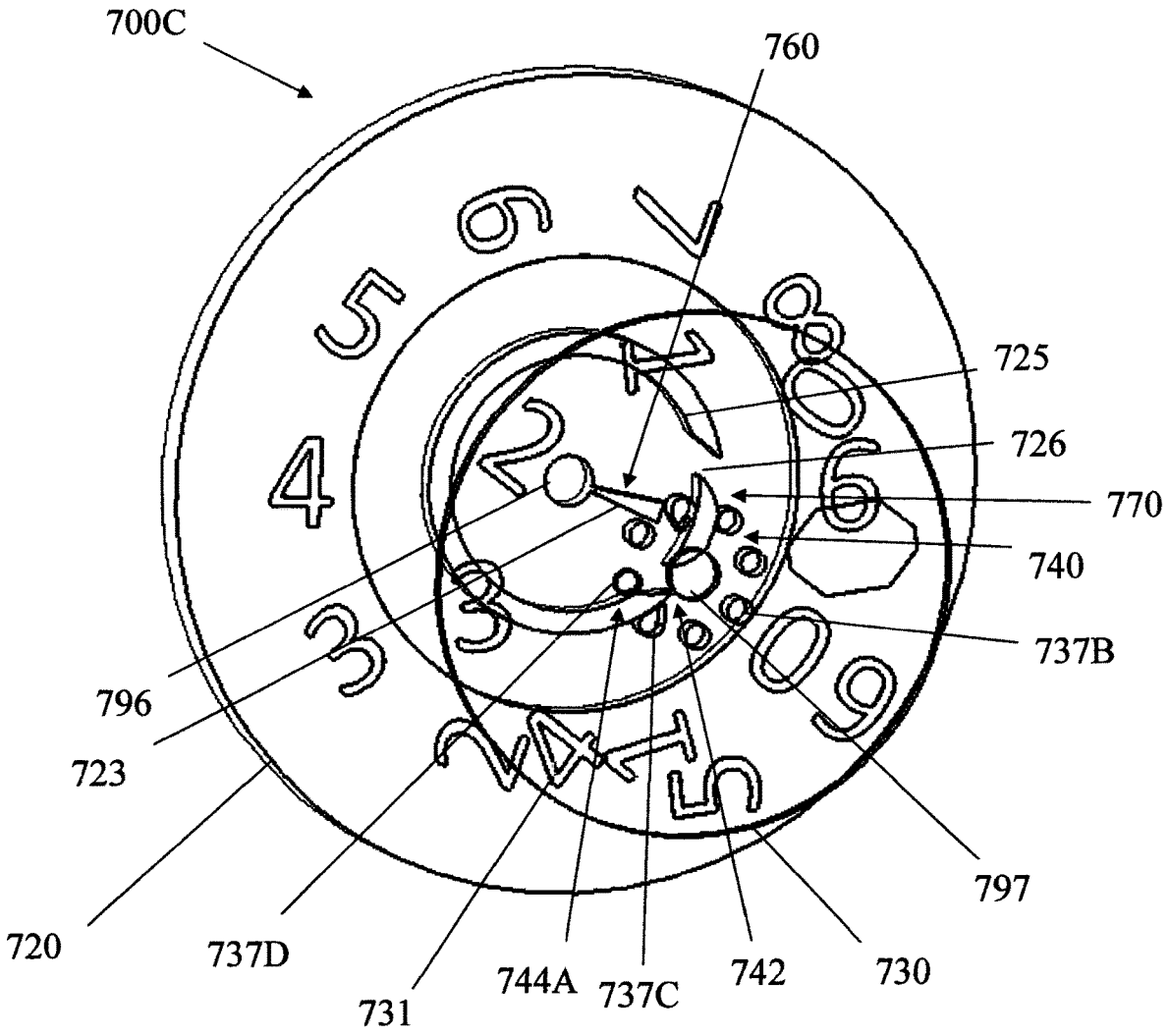
FIG. 7F shows a partial schematic perspective view of the ninth embodiment of the counting device according to the invention.

FIG. 7F shows a counting device 700C according to a ninth embodiment of the invention. The counting device 700C is an alternative arrangement to counting device 700A,700B. Counting device 700C is identical to counting device 700A except that the second counting wheel pegs 737A of counting device 700A have been replaced with second counting wheel pegs 737B which have two tear drop shaped pegs 737C and a half peg 737D arranged between them which form a non-release rotational locking mechanism 744A in combination with first counting wheel rail 725 such that after seven rotations of the second counting wheel 730A,B, it is not possible to rotate the second counting wheel. This is because second counting wheel half peg 737D does not engage the first counting wheel indexing peg 723. This alternative embodiment may also be applied to other embodiments. It has the advantage of preventing the counting device 700C displaying an erroneous count.

In this specification, the verb "comprise" has its normal dictionary meaning, to denote non-exclusive inclusion. That is, use of the word "comprise" (or any of its derivatives) to include one feature or more, does not exclude the possibility of also including further features. The word "preferable" (or any of its derivates) indicates one feature or more that is preferred but not essential.

The reader's attention is directed to all and any priority documents identified in connection with this application and to all and any papers and documents which are filed concurrently with or previous to this specification in connection with this application and which are open to public inspection with this specification, and the contents of all such papers and documents are incorporated herein by reference.

All or any of the features disclosed in this specification (including any accompanying claims, abstract and drawings), and/or all or any of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A counting device for counting mechanical inputs comprising:

a rotatably mounted first counting wheel arranged to rotate by a predetermined amount for every input that is to be counted; a second counting wheel in mechanical communication with the first counting wheel, and at least in part overlapping the first counting wheel; and a housing; whereby the mechanical communication between the first counting wheel and the second counting wheel comprises:

a rotation mechanism configured to drive the second counting wheel a predetermined amount when a predetermined number of inputs has been reached; wherein the rotation mechanism comprises a first counting wheel formation configured to engage with at least one second counting wheel formation; and a rotational locking mechanism configured to prevent rotation of the second counting wheel wherein the rotational locking mechanism comprises a formation on the second counting wheel configured to engage with the housing or a first counting wheel formation; wherein the rotational locking mechanism is activated by the first counting wheel changing the second counting wheel from a configuration where it can rotate to a configuration where it cannot rotate;

wherein the first counting wheel and the second counting wheel each comprise a circumferential array of counting indicia; wherein the first counting wheel incorporates a circumferential array of unit count indicia provided on an outer annular surface of the first counting wheel and the second counting wheel incorporates a circumferential array of tens count indicia, whereby for every input a unit count indicia is aligned with a tens count indicia that represents the number of inputs;

wherein the units indicia and the tens indicia are configured such that a particular combination of units indicia and tens indicia is displayed; and wherein at least one of the counting wheels comprises a circumferential lip which supports an indicia ring of said counting wheel, the indicia ring comprising the circumferential array of counting indicia on an annular surface, and the circumferential lip having a height sufficient for a counting wheel volume to be formed that receives the other counting wheel.

2. A counting device according to claim 1 wherein the mechanical communication between the first counting wheel and the second counting wheel is direct.

3. A counting device according to claim 1 wherein the first counting wheel engages with the second counting wheel to activate the rotational locking mechanism wherein the first counting wheel comprises a cam track or a rail which activates the rotating locking mechanism.

4. A counting device according to claim 1, wherein the mechanical communication comprises a release mechanism for releasing the locking mechanism and wherein: the release mechanism comprises a first counting wheel cam and a second counting wheel formation or a sliding lock peg; or wherein the release mechanism comprises a first counting wheel rail gap and at least one second counting wheel formation.

5. A counting device according to claim 1 wherein the first counting wheel and the second counting wheel are not coaxial when the locking mechanism is activated.

6. A counting device according to claim 1, wherein the housing incorporates at least one window for viewing count indicia on the first counting wheel and/or on the second counting wheel and wherein the first counting wheel comprises an opaque portion and/or the second counting wheel comprises an opaque portion, whereby, in use, the first counting wheel opaque portion and/or second counting wheel opaque portion is visible through the window.

7. A counting device according to claim 1 wherein the second counting wheel is configured to lock after a predetermined number of rotations such that the release mechanism cannot release the second counting wheel.

8. A counting device according to claim 1 wherein at least one of the counting wheels has a thin edge.

9. A medicament dispenser incorporating the counting device as defined in claim 1.

10. A counting device as defined in claim 1 wherein the second counting wheel and/or the first counting wheel are at least in part transparent.

11. A counting device as defined in claim 1 wherein the first counting wheel and/or second counting wheel forms a circumferential lip.

12. A counting device according to claim 1 wherein such that the first counting wheel and second counting wheels are interleaved.

13. A counting device for counting mechanical inputs comprising:

a rotatably mounted first counting wheel arranged to rotate by a predetermined amount for every input that is to be counted; a second counting wheel in mechanical communication with the first counting wheel, and at least in part overlapping the first counting wheel; and a housing; whereby the mechanical communication between the first counting wheel and the second counting wheel comprises:

a rotation mechanism configured to drive the second counting wheel a predetermined amount when a predetermined number of inputs has been reached; wherein the rotation mechanism comprises a first counting wheel formation configured to engage with at least one second counting wheel formation; and a rotational locking mechanism configured to prevent rotation of the second counting wheel wherein the rotational locking mechanism comprises a formation on the second counting wheel configured to engage with the housing or a first counting wheel formation; wherein the rotational locking mechanism is activated by the first counting wheel changing the second counting wheel from a configuration where it can rotate to a configuration where it cannot rotate;

wherein the first counting wheel and the second counting wheel each comprise a circumferential array of counting indicia; wherein the first counting wheel incorporates a circumferential array of unit count indicia provided on an outer annular surface of the first counting wheel and the second counting wheel incorporates a circumferential array of tens count indicia, whereby for every input a unit count indicia is aligned with a tens count indicia that represents the number of inputs;

wherein the units indicia and the tens indicia are configured such that a particular combination of units indicia and tens indicia is displayed; and wherein the first counting wheel moves the second counting wheel from a configuration where it can rotate to a configuration where it cannot rotate.

14. A counting device according to claim 13, wherein:

the housing comprises a housing slot;

the first counting wheel incorporates a first counting wheel hub and a substantially circular first counting wheel cam track on its surface; and, the second counting wheel incorporates a second counting wheel gear, said second counting wheel gear comprising a second counting wheel gear peg and a plurality of second counting wheel gear indentations whereby the second counting wheel gear peg extends therethrough and is configured to slot into the housing slot on one side and into the first counting wheel cam track on the other side, the second counting wheel gear peg forming an axle about which the second counting wheel is rotatable;

whereby the locking mechanism comprises a location mechanism and the rotational locking mechanism wherein the location mechanism comprises the second counting wheel gear peg engaging the housing slot and the rotational locking mechanism comprises the second counting wheel gear indentation engaging the first counting wheel hub, and the rotation mechanism is formed by the second counting wheel gear indentation engaging the first counting wheel peg, and the release mechanism comprises the first counting wheel cam acting on the second counting wheel gear peg.

15. A counting device according to claim 14, wherein the second counting wheel is movable between a first configuration at the inner end of the housing slot where the location locking mechanism and rotational locking mechanism are engaged, and a second configuration at the other end of the housing slot where the rotational locking mechanism is released.

16. A counting device for counting mechanical inputs comprising:

a rotatably mounted first counting wheel arranged to rotate by a predetermined amount for every input that is to be counted; a second counting wheel in mechanical communication with the first counting wheel, and at least in part overlapping the first counting wheel; and a housing; whereby the mechanical communication between the first counting wheel and the second counting wheel comprises:

a rotation mechanism configured to drive the second counting wheel a predetermined amount when a predetermined number of inputs has been reached; wherein the rotation mechanism comprises a first counting wheel formation configured to engage with at least one second counting wheel formation; and a rotational locking mechanism configured to prevent rotation of the second counting wheel wherein the rotational locking mechanism comprises a formation on the second counting wheel configured to engage with the housing or a first counting wheel formation; wherein the rotational locking mechanism is activated by the first counting wheel changing the second counting wheel from a configuration where it can rotate to a configuration where it cannot rotate;

wherein the first counting wheel and the second counting wheel each comprise a circumferential array of counting indicia; wherein the first counting wheel incorporates a circumferential array of unit count indicia provided on an outer annular surface of the first counting wheel and the second counting wheel incorporates a circumferential array of tens count indicia, whereby for every input a unit count indicia is aligned with a tens count indicia that represents the number of inputs;

wherein the units indicia and the tens indicia are configured such that a particular combination of units indicia and tens indicia is displayed; and wherein the unit count indicia are provided on a first counting wheel indicia ring and the tens count indicia are provided on a second counting wheel indicia ring and wherein the second counting wheel at least partially overlaps the first counting wheel such that the second counting wheel indicia ring at least partially overlaps the first counting wheel indicia ring.

* * * * *